US011339751B2

(12) United States Patent
Moyer et al.

(10) Patent No.: US 11,339,751 B2
(45) Date of Patent: May 24, 2022

(54) INDUCTION SYSTEM INCLUDING A HYDROCARBON TRAP

(71) Applicant: Ford Global Technologies, LLC, Dearborn, MI (US)

(72) Inventors: David Moyer, Sterling Heights, MI (US); Jose Quezada, Tlalnepantla (MX); Victor Cisneros, Mexico City (MX); Juan Pablo Salgado, Cuautitlan Izcalli (MX); Scott M. Rollins, Canton, MI (US); Roger Khami, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 315 days.

(21) Appl. No.: 16/216,820

(22) Filed: Dec. 11, 2018

(65) Prior Publication Data

US 2020/0182205 A1 Jun. 11, 2020

(51) Int. Cl.
*F02M 35/02* (2006.01)
*F02M 35/10* (2006.01)
*F02M 35/024* (2006.01)

(52) U.S. Cl.
CPC ..... *F02M 35/0218* (2013.01); *F02M 35/024* (2013.01); *F02M 35/10124* (2013.01); *F02M 35/10222* (2013.01); *F02M 35/10268* (2013.01); *F02M 35/10281* (2013.01)

(58) Field of Classification Search
CPC ..... F02M 35/0218; F02M 35/024; F02M 35/10124; F02M 35/10222; F02M 35/10268; F02M 35/10281; B01D 46/002; B01D 46/0043; B01D 50/0002; F01N 1/24
USPC ..... 96/147, 380–388
See application file for complete search history.

(56) References Cited

U.S. PATENT DOCUMENTS

| | | | | |
|---|---|---|---|---|
| 7,918,912 | B2 | 4/2011 | Tomlin et al. | |
| 8,191,535 | B2 | 6/2012 | Bellis et al. | |
| 8,485,311 | B2 | 7/2013 | Mackenzie et al. | |
| 8,967,128 | B2 | 3/2015 | Bellis | |
| 9,121,373 | B2 | 9/2015 | Moyer et al. | |
| 9,174,163 | B2 | 11/2015 | Bellis et al. | |
| 9,581,115 | B2 | 2/2017 | Moyer et al. | |
| 9,732,710 | B2 | 8/2017 | Bellis et al. | |
| 2006/0054142 | A1 | 3/2006 | Burke et al. | |
| 2006/0272509 | A1* | 12/2006 | Uemura | F02M 35/024 96/134 |
| 2008/0028938 | A1* | 2/2008 | Li | F02M 35/10386 96/134 |
| 2009/0120046 | A1* | 5/2009 | Huff | B01D 46/0036 55/290 |
| 2010/0000190 | A1* | 1/2010 | Kidman | B01D 46/10 55/502 |
| 2013/0092472 | A1* | 4/2013 | Ostler | F02M 35/10 181/256 |

(Continued)

*Primary Examiner* — T. Bennett McKenzie
*Assistant Examiner* — Qianping He
(74) *Attorney, Agent, or Firm* — Geoffrey Brumbaugh; McCoy Russell LLP

(57) ABSTRACT

Methods and systems are provided for a hydrocarbon (HC) trap system in an engine air induction system. In one example, a system may include a pillow-case type HC trap housed in a rectangular opening formed in a wall of an air conduit at the outlet of an air cleaner box. A frame may be integrally formed around the opening to support the HC trap protruding outward from the wall.

12 Claims, 22 Drawing Sheets

(56) References Cited

U.S. PATENT DOCUMENTS

| | | | | |
|---|---|---|---|---|
| 2015/0219046 | A1* | 8/2015 | Weckerle | B01J 20/3035 96/147 |
| 2018/0149122 | A1* | 8/2018 | Hartmann | F02M 35/10157 |

* cited by examiner

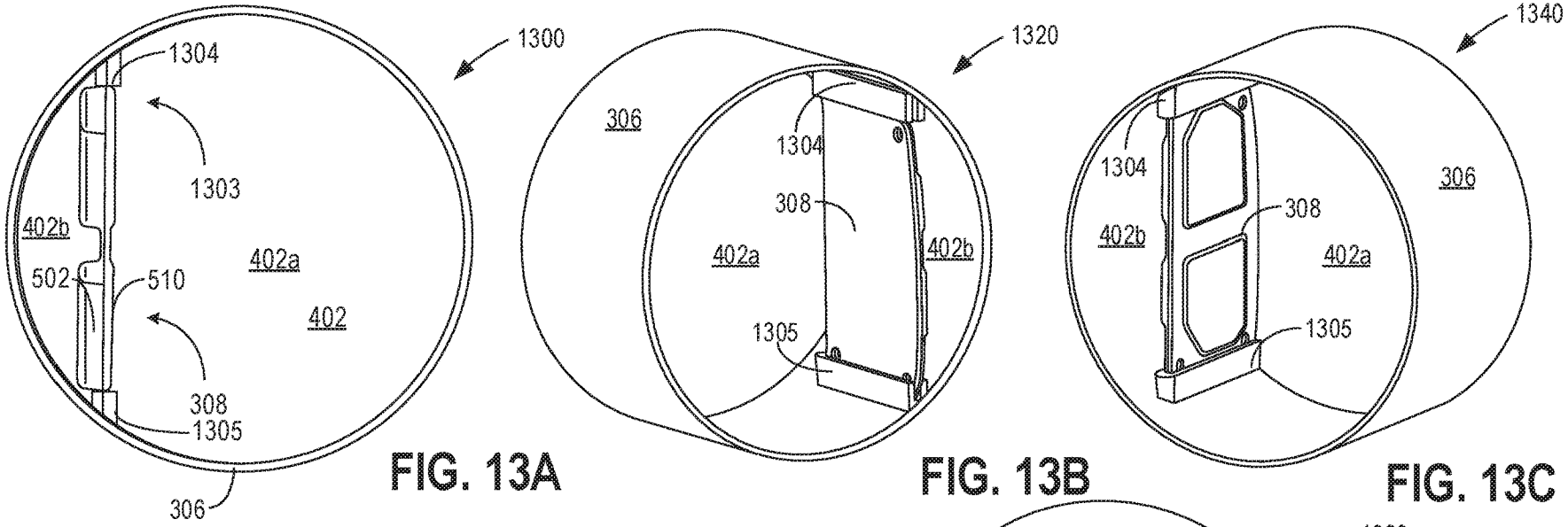
FIG. 13A
FIG. 13B
FIG. 13C
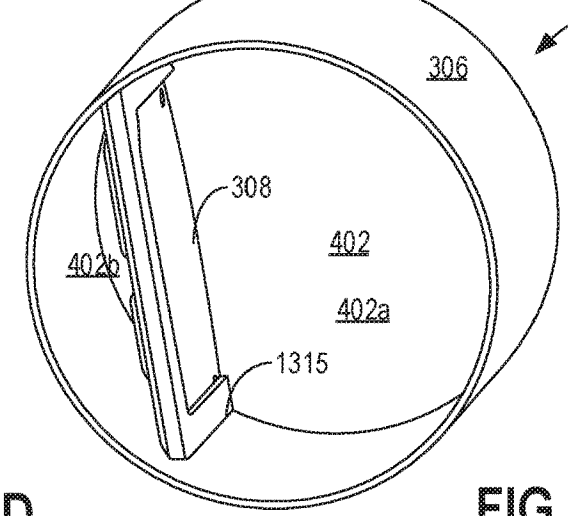
FIG. 13D
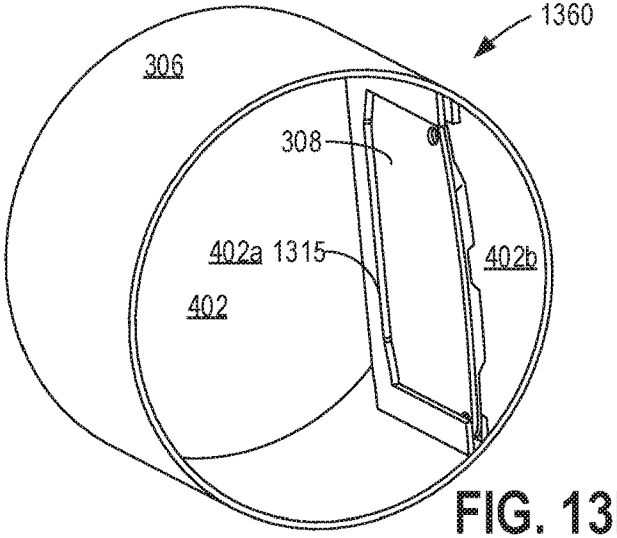
FIG. 13E

INDUCTION SYSTEM INCLUDING A HYDROCARBON TRAP

FIELD

The present description relates generally to methods and systems for including a hydrocarbon trap in the air induction system.

BACKGROUND/SUMMARY

Evaporative emissions may be caused by fuel vapor escaping from various systems, components, etc., in an engine or other portions of a vehicle. For example, fuel sprayed into an intake manifold, by a fuel injector, may remain on the walls in intake manifold after the engine is shut down and not performing combustion. Consequently, fuel vapor may flow out of the intake system during engine shut down. As a result, evaporative emissions may be increased and in some cases exceed government mandated requirements. Evaporative emissions also have an environmental impact. For example, the emission may create an atmospheric haze when exposed to sunlight. Hydrocarbon (HC) vapor traps are used in the air induction path of internal combustion engines to capture hydrocarbon vapors emanating from within the engine, fuel system, pollution control system, and/or related components, and which would otherwise escape into the environment.

Various approaches are provided for incorporating a HC trap in the engine intake system. For example, US 2006/0054142 discloses an intake system with a hydrocarbon trap positioned at a low point in the intake system to capture fuel vapor. A hydrocarbon-adsorptive medium, such as activated carbon may be disposed in a gravitationally low point in the intake air flow passageway between the entrance to the system and the engine. The intake duct itself may be configured to provide the low region for disposition of the medium. Fuel vapors may be absorbed and released from the hydrocarbon trapping medium to reduce evaporative emissions.

However, the inventors herein have recognized potential disadvantages with the above approach. As one example, integrated HC adsorbing material such as activated charcoal into a housing of a conduit in the intake system may increase the manufacturing cost of the intake system, as well as reduce the adaptability of the hydrocarbon trap. The direct attachment of the activated carbon to the housing may inhibit the trap from being easily removed, repaired, and/or replaced, and may increase manufacturing costs. Furthermore, the activated carbon may not properly adhere to the housing. As a result, the activated carbon may be released into the intake system and flow downstream into the engine, degrading engine operation. Moreover, the hydrocarbon trap is positioned at a low point in the intake system, thereby constraining the position of the hydrocarbon trap.

The inventors herein have recognized that the issues described above may be addressed by a system comprising: a hydrocarbon (HC) pillow-case type trap housed within a rectangular cavity formed in a wall of a cylindrical passage. In this way, by coupling a HC trap to a cavity integrally formed on an air intake system tubular duct, HC trap assembly may be simplified and HC trap efficiency may be improved.

In one example, an intake air filter system may include an injection molded duct coupled to a clean air side of an air cleaner box. A cavity or opening may be integrally formed on a side of the wall of the duct, the cavity including a plurality of guiding structures such as finger ribs and alignment pins. A pillow case type HC trap may be positioned via a poke-yoke arrangement within the cavity and then covered with a retention cap. The HC trap may be aligned at an angle relative to the vertical axis of the duct. The cavity may be formed along the length or width of the duct. The duct may include a pair of cavities to house two HC traps. In an alternate embodiment, the pillow-case type HC trap may be housed within a pocket formed within the bore of the duct or on the outer wall of the duct. The HC trap may be slid into a slot formed in the pocket and a protective cap may be placed over the pocket.

In this way, by coupling the HC trap to a cavity integrally formed within a wall of the clean air duct via a poke-yoke arrangement, HC trap assembly into the intake air system may be simplified. Due to the poke-yoke arrangement, erroneous positioning of the HC trap may be averted during the assembly. By integrally injection molding locating pins and finger ribs, the HC trap may be installed with fewer components, thereby reducing cost of assembly. Further, the finger ribs and the cavity volume may reduce noise and vibration in the intake air filter system. The technical effect of positioning the HC trap at an angle is that any fluid in the intake system may drain off the HC trap & not form a puddle on the HC Trap. Overall, by using a single linear axis of assembly in the duct of the air filter system to position a HC trap, assembly of the HC trap may be automated with lower possibility of error and improved cost efficiency.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 13A-13E show a fifth embodiment of the HC trap assembly shown in FIG. 2.

FIGS. 3-18 are drawn to scale, although other relative dimensions may be used, if desired.

DETAILED DESCRIPTION

Figure 2:
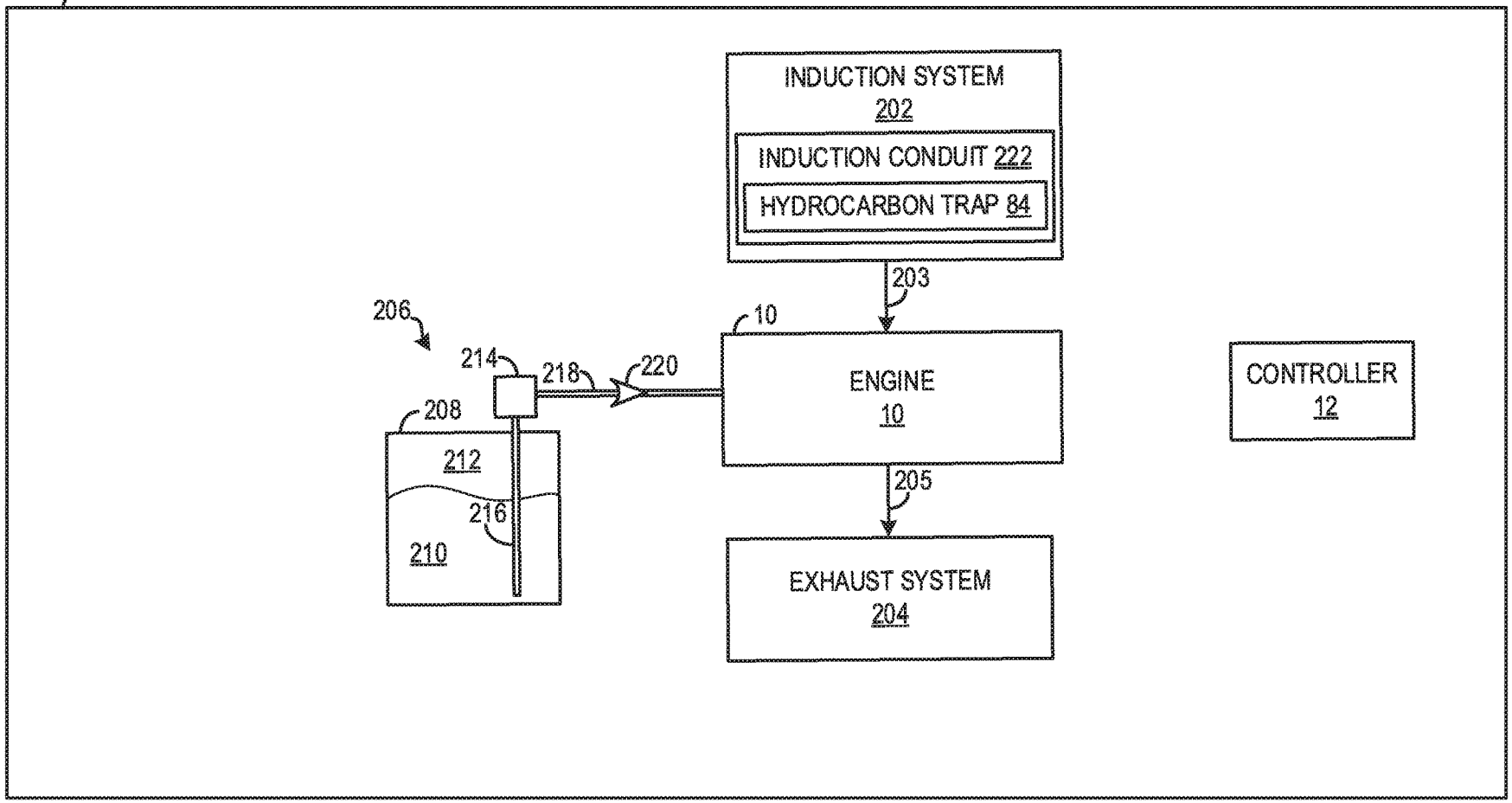
FIG. 2 shows a schematic depiction of a vehicle including a fuel delivery system, an induction system having a passive-adsorption hydrocarbon trap, an exhaust system, and the engine of FIG. 1.
Figure 3:
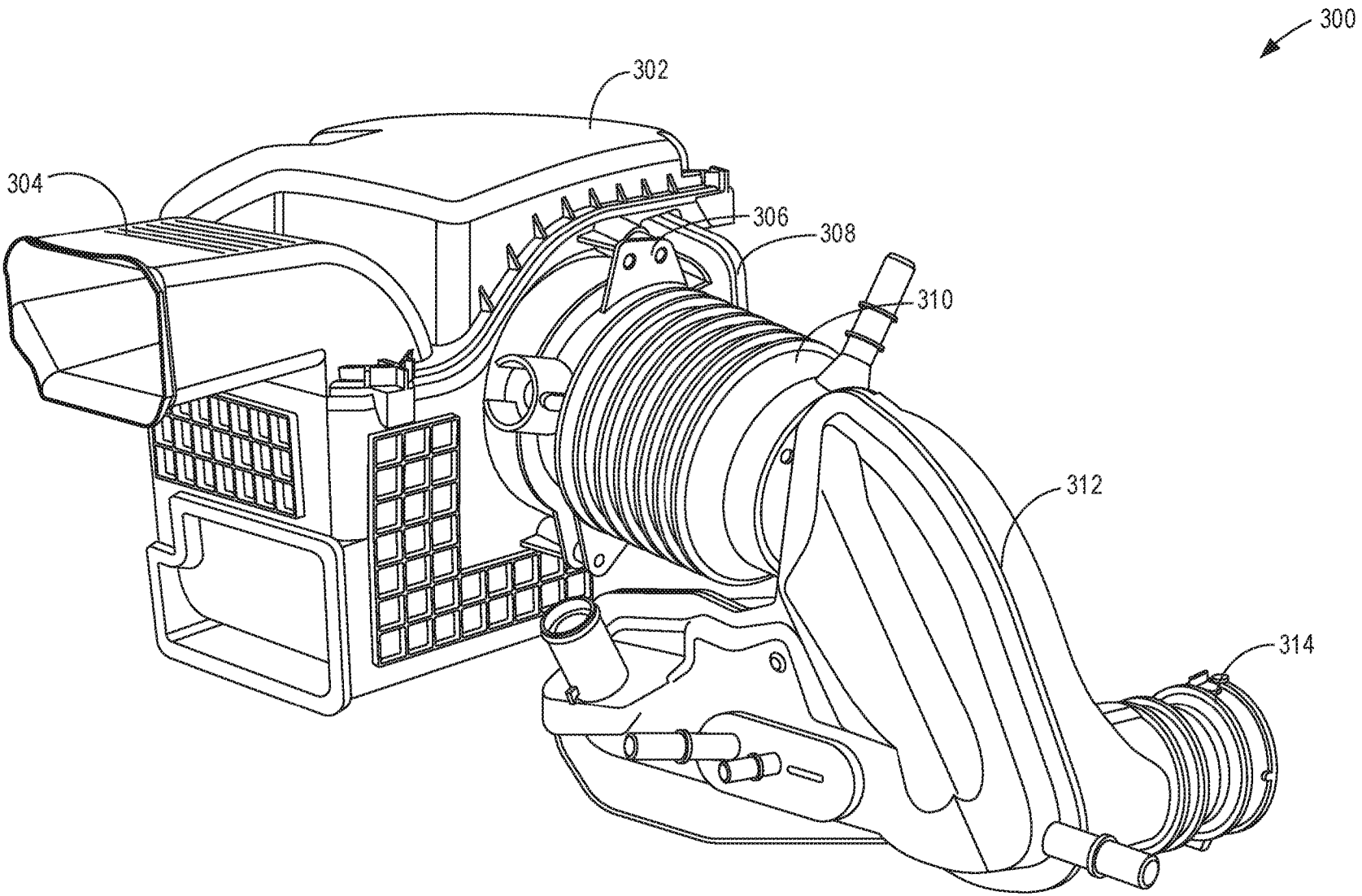
FIG. 3 shows a hydrocarbon (HC) trap assembly coupled to an air induction system.

The following description relates to systems and methods for a hydrocarbon (HC) trap assembly in the engine intake system. A pillow case-type HC trap may be incorporated in the intake system of an engine system, such as the engine system in FIG. 1. FIG. 2 shows a schematic depiction of a vehicle including the engine system shown in FIG. 1 and an induction system including the HC trap. An example HC trap assembly may be coupled to the air induction system as shown in FIG. 3. Example embodiments of the HC trap assembly and components of the respective embodiments are seen in FIGS. 4A-17D.

Figure 1:
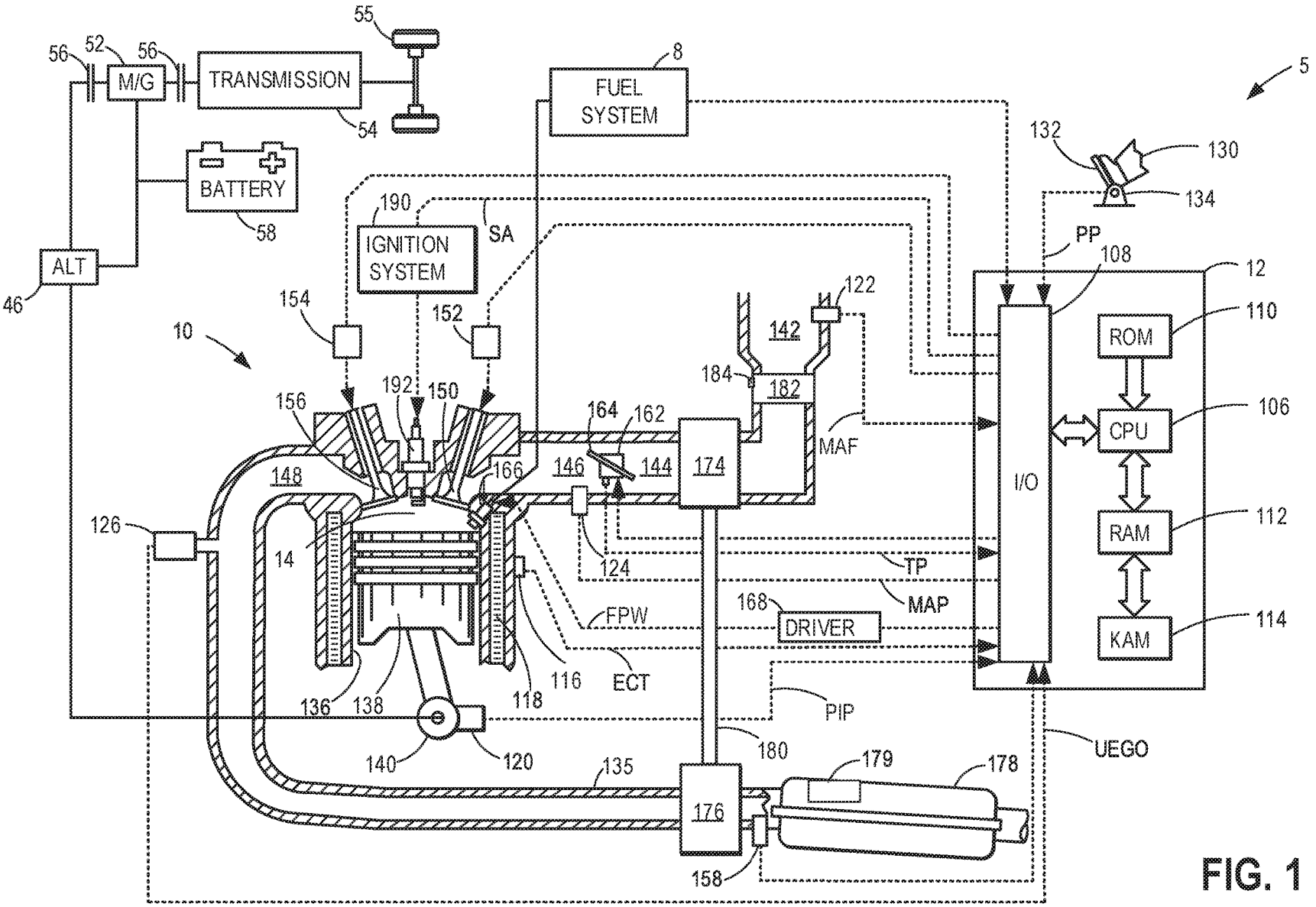
FIG. 1 shows a schematic depiction of a vehicle including an engine system.

FIG. 1 depicts an example of a cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as further described below. Further, a starter motor (not shown) may be coupled to crankshaft 140 via a flywheel to enable a starting operation of engine 10.

In some examples, the vehicle 5 may comprise an autonomous vehicle and/or a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, electric heater coupled to an electrically heated catalyst (EHC), vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted. In still other examples, engine 10 may be provided with an electric supercharger (e.g., an "eBooster"), and compressor 174 may be driven by an electric motor.

An intake air filter system 182 including an air cleaner box may be housed in the air intake passage 142 to remove impurities from intake air reaching the compressor 174. A pillow case type hydrocarbon (HC) trap 184 may be coupled to a cylindrical passage at the outlet of an air filter system to capture hydrocarbon vapors emanating from within the engine, fuel system, pollution control system, and/or related components, and which would otherwise escape into the environment. A rectangular enclosure may be integrally formed around a rectangular cavity in the wall of the cylindrical passage, the enclosure including a plurality of finger ribs to engage the HC trap in a poke-yoke assembly, and reduce noise and vibration in the engine air induction system. The HC trap may include a flat side surface and two lobes separated by a ridge, the lobes housing a hydrocarbon adsorbent material. The HC trap may be inclined at an angle relative to a vertical axis of the cylindrical passage to reduce fluid accumulation on the surface of the HC trap. Embodiments of an example HC trap assembly 184 is elaborated in relation to FIGS. 3-17D. In one example, a mass air flow sensor (MAFS) 122 or air Intake temperature sensor (IAT) 122 may be included in the air filter system 182. By including the HC trap in the air filter system 182, HC may be effectively adsorbed without a significant effect on airflow and engine power.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

An exhaust manifold 148 can receive exhaust gases from other cylinders of engine 10 in addition to cylinder 14. An exhaust gas sensor 126 is shown coupled to exhaust manifold 148 upstream of an emission control device 178. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO. Emission control device 178 may be a three-way catalyst, a NOx trap, various other emission control devices, or combinations thereof. In the example of FIG. 1, emission control device 178 is an electrically heated catalyst (EHC). An electric heater (herein also referred to as a heating element) 179 may be coupled to the EHC 178 to electrically heat the catalyst during cold-start conditions. By actively heating the EHC 178, catalyst light-off may be expedited, thereby improving emissions quality during cold-start conditions.

An exhaust gas recirculation (EGR) delivery passage may be coupled to the exhaust passage upstream of turbine 176 to provide high pressure EGR (HP-EGR) to the engine intake manifold, downstream of compressor 174. An EGR valve may be coupled to the EGR passage at the junction of the EGR passage and the intake passage. EGR valve may be opened to admit a controlled amount of exhaust to the compressor outlet for desirable combustion and emissions control performance. EGR valve may be configured as a continuously variable valve or as an on/off valve. In further embodiments, the engine system may include a low pressure EGR (LP-EGR) flow path wherein exhaust gas is drawn from downstream of turbine 176 and recirculated to the engine intake manifold, upstream of compressor 174.

Each cylinder of engine 10 may include one or more intake valves and one or more exhaust valves. For example, cylinder 14 is shown including at least one intake valve 150 and at least one exhaust valve 156 located at an upper region of cylinder 14. In some examples, each cylinder of engine 10, including cylinder 14, may include at least two intake valves and at least two exhaust valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 135; a profile ignition pickup signal (PIP) from a Hall effect sensor 120 (or other type) coupled to crankshaft 140; throttle position (TP) from a throttle position sensor; signal UEGO from exhaust gas sensor 126, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of emission control device 178 based on the signal received from temperature sensor 158.

Controller 12 receives signals from the various sensors of FIG. 1 and employs the various actuators of FIG. 1 to adjust engine operation based on the received signals and instructions stored on a memory of the controller. For example, the controller may operate a single pump coupled to two engine valves based on valve timing and a position of the valve to open or close the respective valve.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

FIG. 2 shows a vehicle 200 including the engine 10. The vehicle 200 further includes an induction system 202 configured to supply air to combustion chambers in the engine 10. Thus, the induction system 202 may draw air from the surrounding environment and provide the air to the engine 10. Arrow 203 denotes the flow of intake air from the induction system 202 to the engine 10. The induction system 202 may include various components, such as the throttle 162, intake manifold 146, and intake passage 142, 144 shown in FIG. 1.

The vehicle 200 further includes an exhaust system 204 configured to receive exhaust gas from the engine 10. The exhaust system 204 may include the exhaust manifold 148 and the emission control device 178 shown in FIG. 1. It will be appreciated that the exhaust system 204 may receive exhaust gas from the engine 10 and expel the exhaust gas into the surrounding environment. Arrow 205 denotes the flow of exhaust gas from the engine 10 into the exhaust system 204.

The vehicle 200 further includes a fuel delivery system 206 including a fuel tank 208 housing a fuel 210 such as gasoline, diesel, bio-diesel, alcohol (e.g., ethanol, methanol), or a combination thereof. Fuel vapor 212 may also be enclosed in the fuel tank 208.

The fuel delivery system 206 further includes a fuel pump 214 having a pick-up tube 216 extending into the fuel tank 208. In the depicted example the fuel pump 214 is positioned external to the fuel tank 208. However, in other examples the fuel pump 214 may be positioned in the fuel tank 208.

A fuel conduit 218, included in the fuel delivery system 206, enables fluidic communication between the fuel pump 214 and the engine 10. Arrow 220 indicates the flow of fuel into the engine 10. The fuel delivery system 206 may also include valves for regulating the amount of fuel provided to the engine 10. It will be appreciated that the fuel delivery system 206 may include additional components that are not depicted such as injectors (e.g., direct injectors, port injectors), a higher pressure fuel pump, a fuel rail, etc.

The induction system 202 includes at least one induction conduit 222. The induction conduit 222 may include a hydrocarbon trap 84. The hydrocarbon trap 84 may be positioned in an air filter system 182 upstream of the throttle 162 shown in FIG. 1, in some examples. However, other positions for the passive-adsorption hydrocarbon trap have been contemplated. For example, the hydrocarbon trap 84 may be positioned within the intake manifold 144, shown in FIG. 1. Continuing with FIG. 2, the hydrocarbon trap 84 is configured to absorb fuel vapor. In this way, the hydrocarbon trap 84 may reduce the amount of emissions escaping from the induction system 202 when the engine 10 is not performing combustion.

The induction conduit 222 is in fluidic communication with the combustion chamber 14 shown in FIG. 1. The induction conduit 222 may be positioned upstream of the throttle 162, in some examples. It will be appreciated that the fuel pump 214 may be controlled via controller 12. However, in other examples, the fuel pump 214 may be controlled via an internal controller.

FIG. 3 shows a first embodiment 300 of a hydrocarbon (HC) trap assembly coupled to an air induction system. The air induction system may include a cuboid shaped air cleaner box 302. Ambient air may enter the air cleaner box 302 via an intake passage 304 fluidically coupling the engine to the atmosphere. The outlet of the air cleaner box 302 may include a duct (also referred herein as air conduit or cylindrical passage) 306 followed by a passage 310 leading to the engine intake manifold 146. A throttle or turbocharger inlet may be positioned in the engine intake manifold 146 to regulate the amount of air entering the clean air tube (CAT) 312 of one or more engine cylinders. Air from the air cleaner box 302 may be supplied to intake port 312 via each of the duct 306, the passage 310, and the engine clean air tube 312.

The duct 306 may be cylindrical with a uniform cross section. A HC trap system 308 may be coupled to a wall of the duct 306. The HC trap system 308 may be the HC trap system 84 in FIGS. 1 and 2. The HC trap system 84 may be coupled along the circumference of the duct 306. In this example, the HC trap system 308 may protrude outward from the duct 306 towards the right side of the air cleaner box 302. However, in alternate arrangements, the HC trap may be coupled in any direction along the wall of the duct 306. The HC trap may be coupled to the duct 306 in a plurality of arrangements (separate embodiments). A detailed description of a first embodiment of a HC trap system 308 is discussed with relation to FIGS. 4A-4B.

Figure 4B:
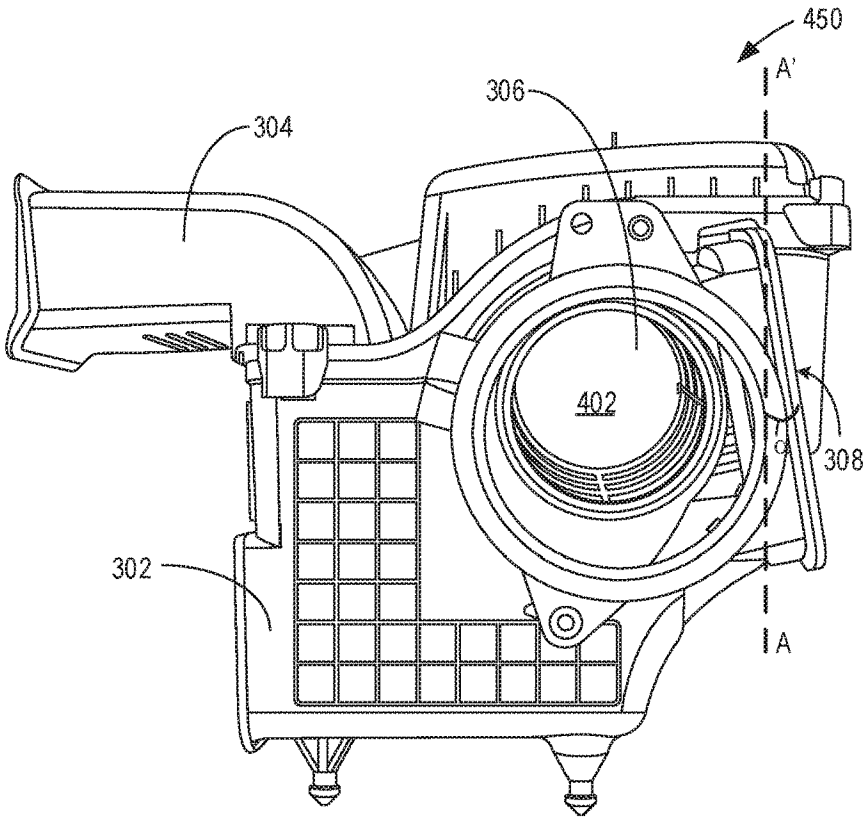
FIGS. 4A-4B show perspective views of a first embodiment of the HC trap assembly.
Figure 4A:
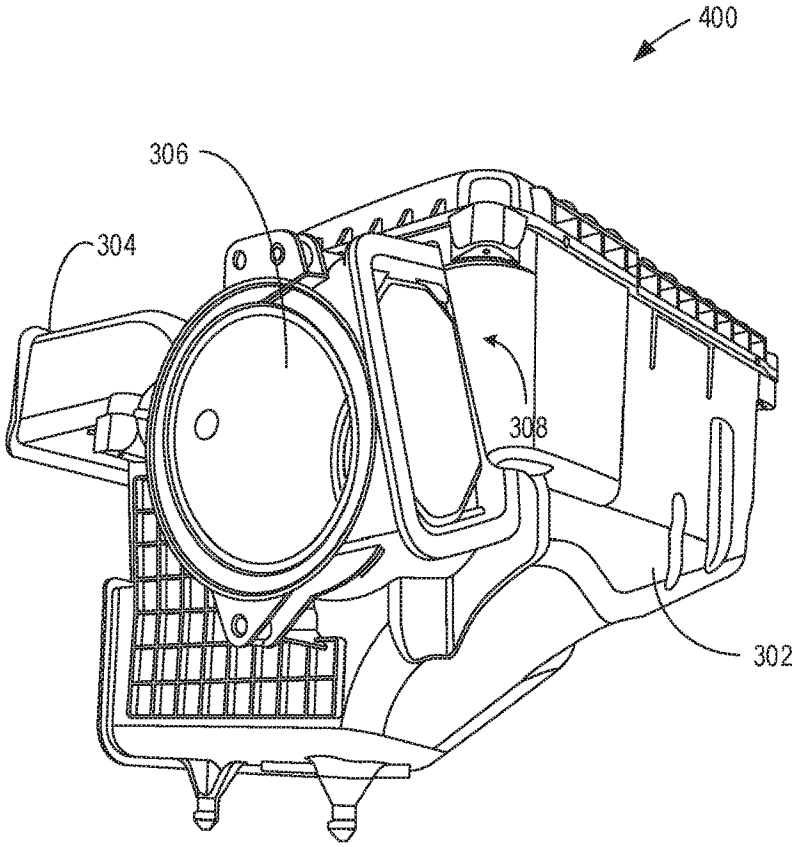

FIG. 4A shows a side perspective view 400 of a first embodiment of the HC trap system 308 housed in the air induction system and FIG. 4B shows a front view 450 of the first HC trap system 308 housed in the air induction system. Components previously introduced in FIG. 3 are numbered similarly and not reintroduced.

A duct 306 comprising a bore may be coupled to the outlet of an air cleaner box 302 of the air induction system 202. The duct 306 may be injection molded with a hollow rectangular cavity (also referred herein as recess, window, or opening) integrally formed in the wall of the duct. In this way, the cavity may be formed as an integral structure in the duct wall. The cavity may be rectangular, circular, or polygonal with 3 or more sides. A rectangular HC trap 308 may be coupled to the cavity via a poke-yoke arrangement and then covered with a retention cap. The HC trap system 308 may protrude outward from the exterior wall of the duct 306.

The rectangular cavity may be formed at an angle (such as □, as shown in FIG. 4B) with respect to a vertical axis A-A' of the duct. Due to the angled cavity, the HC trap system 308 may form an angle (□) to the vertical axis. In one example, □□ may be 30°. Due to the angled positioning of the HC trap system, water (such as water vapor condensate from ambient air or other fluids) may not accumulate on the HC trap system and may slide off the cap of the HC trap system 308. Water/fluid accumulation on the HC trap system 308 may have led to increased weight on the HC trap causing structural damage. In this way, by averting water accumulation on the HC trap system 308, structural and chemical robustness of the HC trap system 308 may be maintained.

Figure 5A:
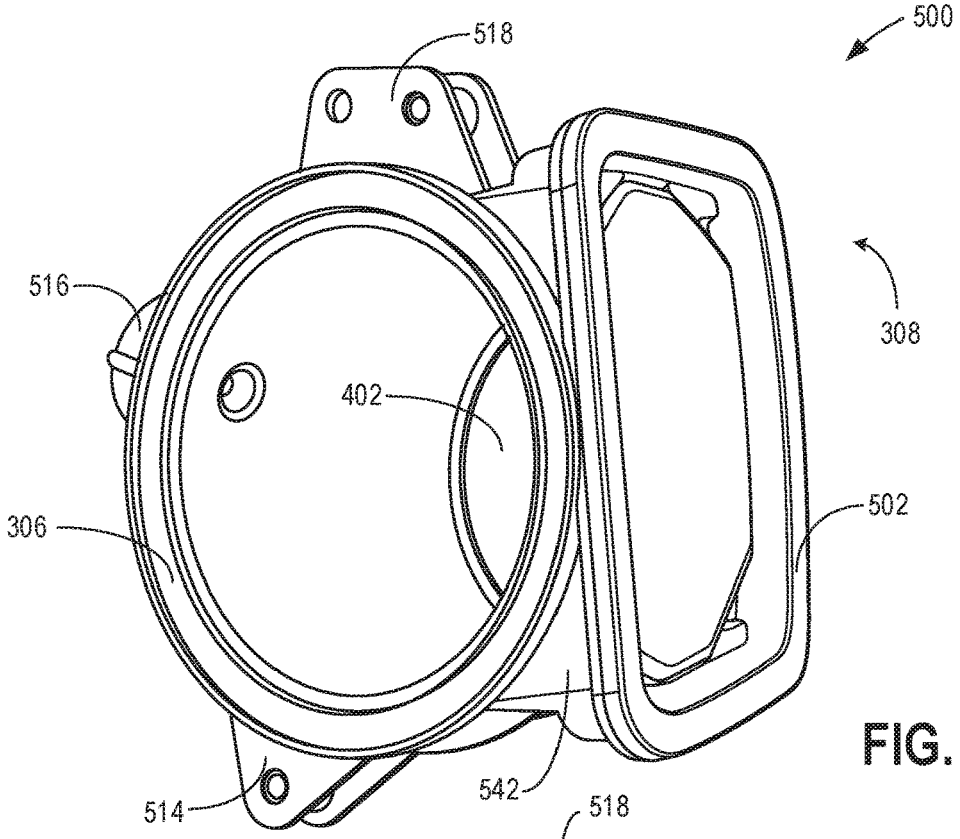
FIGS. 5A-5F show the HC trap in the first embodiment of the HC trap assembly.
Figure 5B:
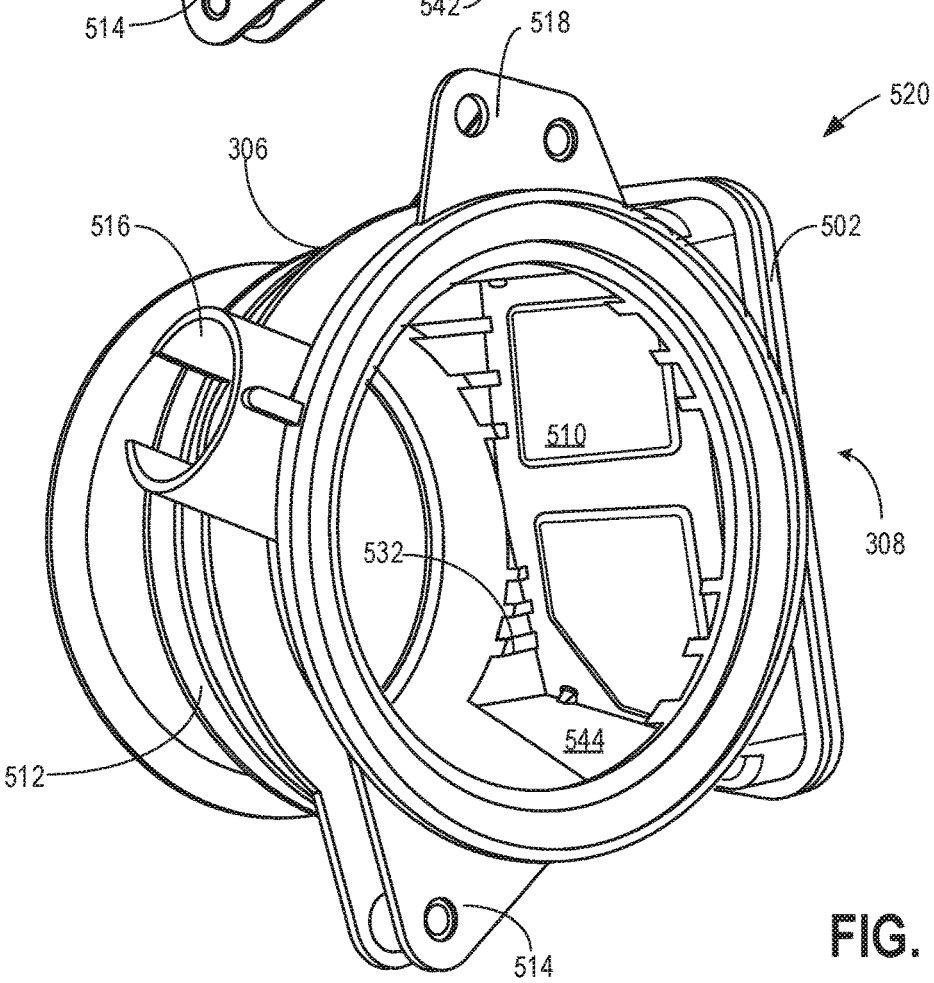

FIG. 5A shows a right side perspective view 500 of the first embodiment of the HC trap system 308 and FIG. 5B shows a left side perspective view 520 of the first embodiment of the HC trap system 308. The HC trap assembly may include a duct 306 positioned at an outlet of an air cleaner box of the air induction system. The HC trap may be pillow case type, flat sheet media type, or other HC Trap media/styles. The outer wall of the duct 306 may include a plurality of concentric ribs 532 along the circumference. Also, a plurality of projections 518, 514, and 516 may protrude out of the outer wall of the duct 306. The projections 514 and 518 may include holes for fasteners coupling the duct 306 to the air cleaner. The projection 516 and the ribs 532 may facilitate in coupling the duct 306 to the air cleaner box within the air induction system.

A cavity (circular, oval, polygonal etc.) may be formed on the right side of the wall of the duct 306 (also referred herein as air conduit or cylindrical passage). An injection molded rectangular enclosure 542 may be positioned around the cavity to hold the HC trap system 308. The duct 306 along with the enclosure 542 may be integrally part of a single structure without any couplings, the enclosure 542 molded around the cavity. The height of the enclosure 542 may vary across the length of the enclosure with the height being highest at the two ends and the height being lowest at the center of the enclosure. An arcuate first end of the enclosure may be adjoining the wall of the duct 306 (around the cavity) while a second, flat end may be in contact with the HC trap system 308. The HC trap system 308 may be fixed within the cavity (on the enclosure 542) via a poke-yoke arrangement. A plurality of finger ribs 532 and support lands 544 may be formed within the cavity to align and hold the HC trap system 308 within the cavity.

The HC trap system 308 may include a pillow-case type trap 510 enclosing HC adsorbent material and a retention cap 502 covering the pillow-case type trap 510. The structure of the cavity and the enclosure is discussed in details in relation to FIGS. 6A-6C and the HC trap system 308 is discussed in details in relation to FIGS. 7A-7C.

Figure 5C:
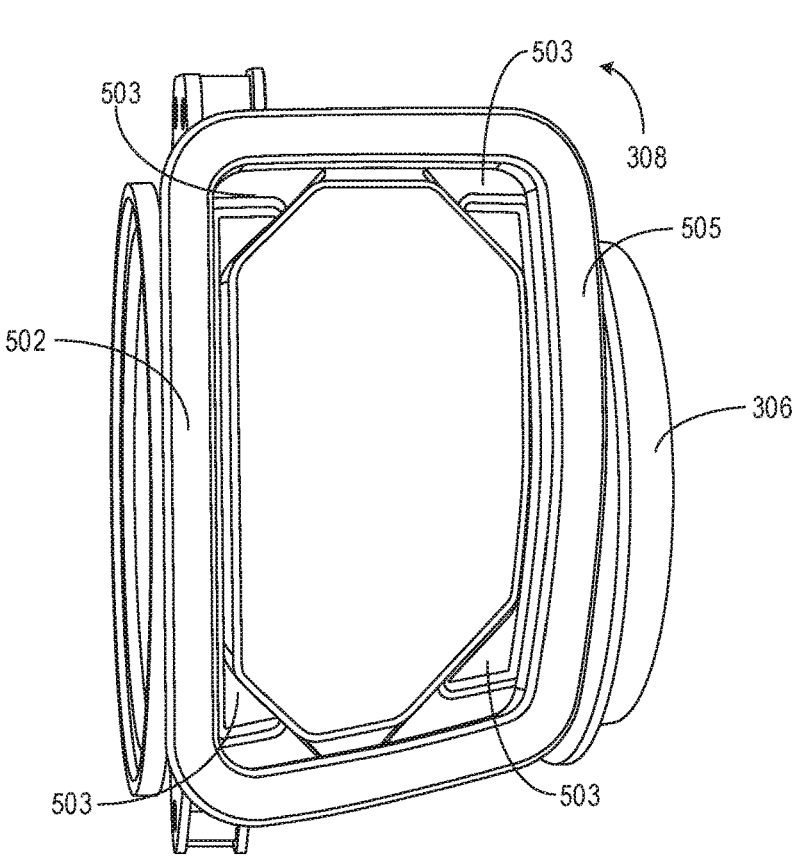

FIG. 5C shows a right view 540 of the first embodiment of the HC trap system 308. The retention cap 502 includes a rectangular rim 505 along the edge of the cap 502. Four triangular depressions 503 may be formed on the surface of the cap 502 at the four corners. The rim 505 may be elevated compared to each of the central portion of the cap 502 and the depressions 503 on the cap.

Figure 5D:
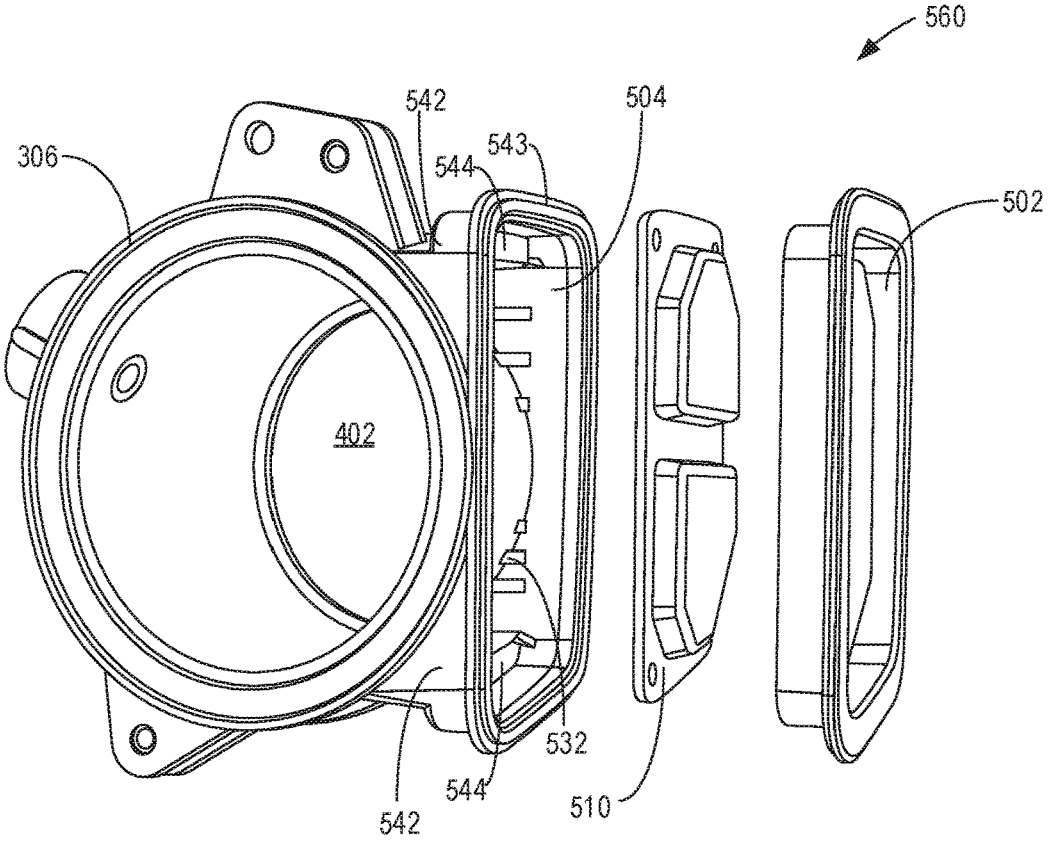

FIG. 5D shows an expanded view 560 of the first embodiment of the HC trap system 308. In this view, the pillow-case type HC trap 510 and the adjoining retention cap 502 are separated from the cavity 504 formed on the side wall of the duct 306. A rectangular enclosure 542 may be injection molded on the cavity providing support or clearance for HC trap positioning. In alternate examples, the enclosure may be circular or polygonal with three or more sides. The enclosure 542 may include a rectangular rim 543 around the edge of the enclosure 542, thereby defining a rectangular opening for HC trap attachment. A plurality of finger ribs 532 may be formed on the side walls of the enclosure 542 to enable engagement of the pillow-case type HC trap 510 within the cavity 504. The finger ribs may have a range of sizes and shapes. The cavity 504 may include four pins (not shown) located at four corners to enable attachment of the pillow-case type HC trap 510 and the cap 502 inside the cavity 504.

The pillow-case type HC trap 510 may include a shell with two separate lobes filled with a HC adsorbing material such as activated carbon. A wall of the pillow-case type HC trap 510 shell facing the cavity 504 may be formed of a breathable material to allow fluidic communication between the air flowing through the bore 402 of the duct 306 and the HC adsorbing material. The lobes may fit into the central portion of the cap 502 while the cap rim 505 may align with the enclosure rim 543. Due to the irregular shape of the HC trap 510 and the cap 502, the components may be coupled in a single unique orientation, thereby eliminating the possibility of erroneous assembly.

Figure 5E:
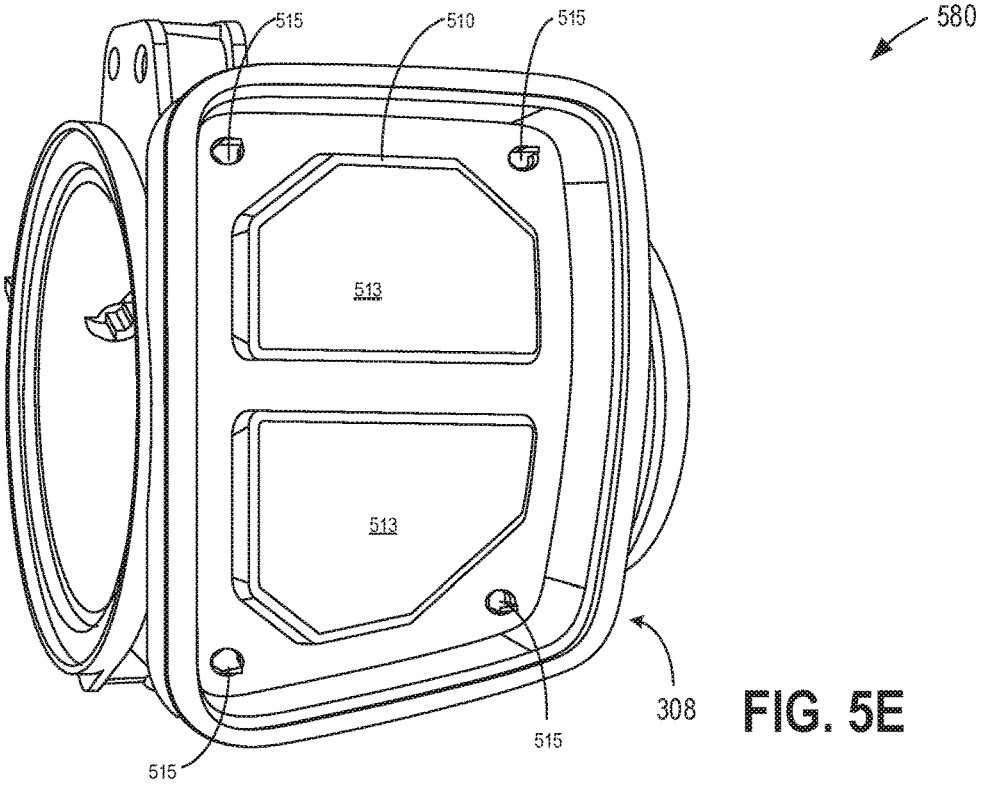

FIG. 5E shows a right view 580 of the first embodiment of the HC trap system 308 with the retention cap being removed from the HC trap. The two lobes 513 containing the HC adsorbate material within the pillow-case type HC trap 510 may protrude outward from the cavity holding the HC trap. In one example, the lobes 513 may be asymmetric with each lobe being a 6-sided structure. In another example, the lobes 513 may be symmetric. There may be a ridge formed between the two lobes 513. In alternate embodiments, there may be one lobe or more than two lobes. There may be four holes 515 along the perimeter or within the flat or curved base of the HC trap to engage with the corresponding pins located at the four corners of the cavity. In one example, the holes may be positioned at the four corners of the HC trap. Since no external fasteners are engaged while attaching the HC trap to the cavity, the assembly process may be simplified and automated.

Figure 5F:
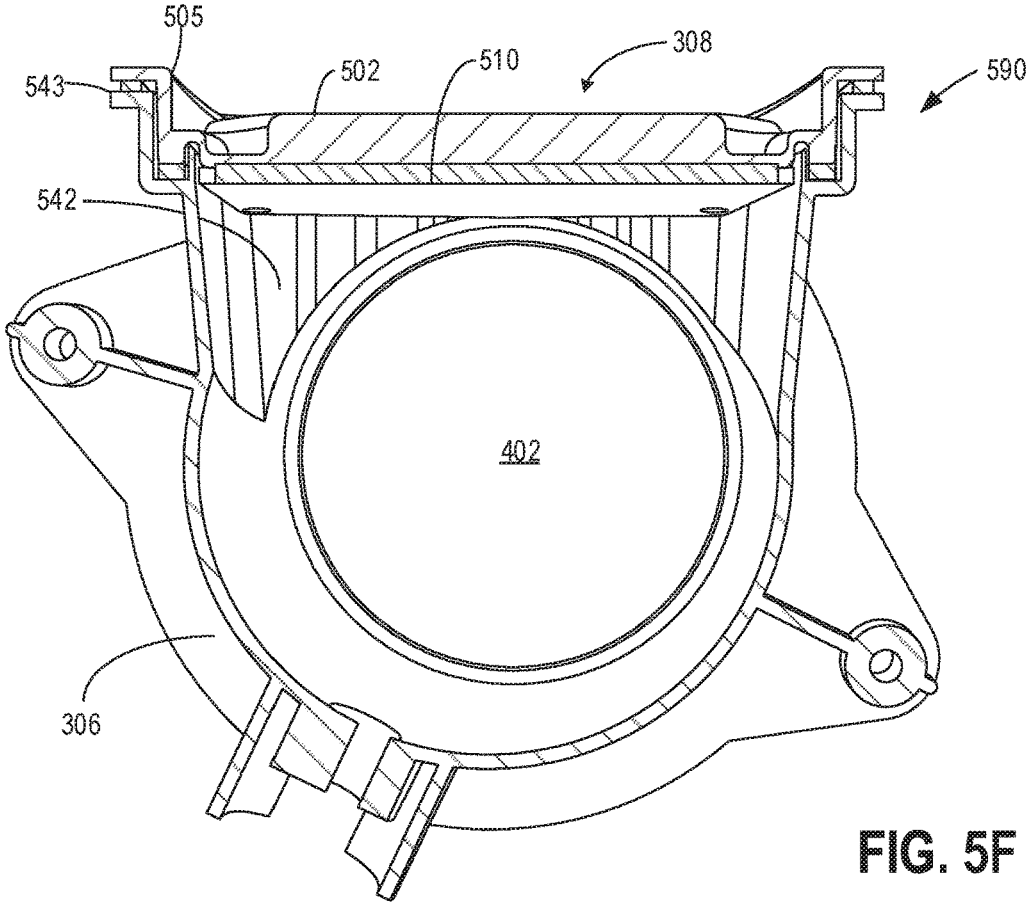

FIG. 5F shows a cross sectional view 590 of the first embodiment of the HC trap system 308. The cross section may be taken across the duct and the HC trap 510. A cross section of the enclosure 542 shows an arcuate first side adjacent to the bore 402 of the duct 306 and a flat second side adjacent to the HC trap 510. The enclosure may include a rim 543 protruding outward, enclosing the HC trap 510. The rim may comprise straight walls at right angle to the second side of the enclosure 542. The cap 502 may be positioned on top of the pillow-case type HC trap with the cap rim 505 positioned directly over the enclosure rim 543. In this way, the HC trap may be enclosed within the area formed between the enclosure and the cap 502. The duct 306 and the enclosure 542 may be molded from a single piece, thereby reducing the number on components used in the HC trap assembly. The pillow-case type HC trap 510 may be placed within the u-shaped frame formed by the enclosure 542 and then the trap may be covered by a cap 502 which aligns with the enclosure 542.

Figure 6C:
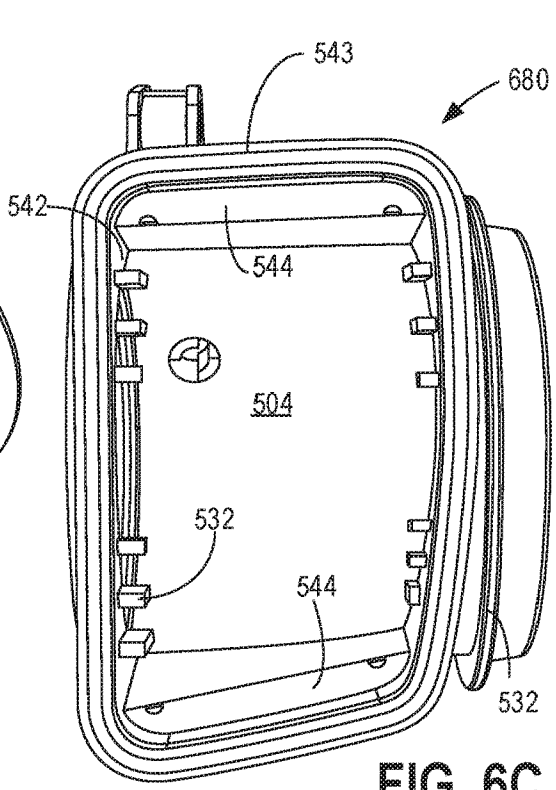
FIGS. 6A-6C show a cavity for housing the HC trap in the first embodiment of the HC trap assembly.
Figure 6B:
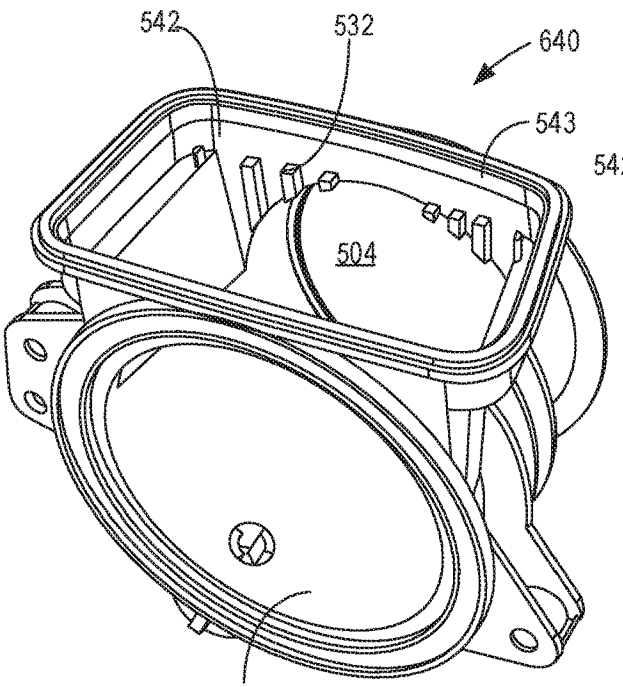
Figure 6A:
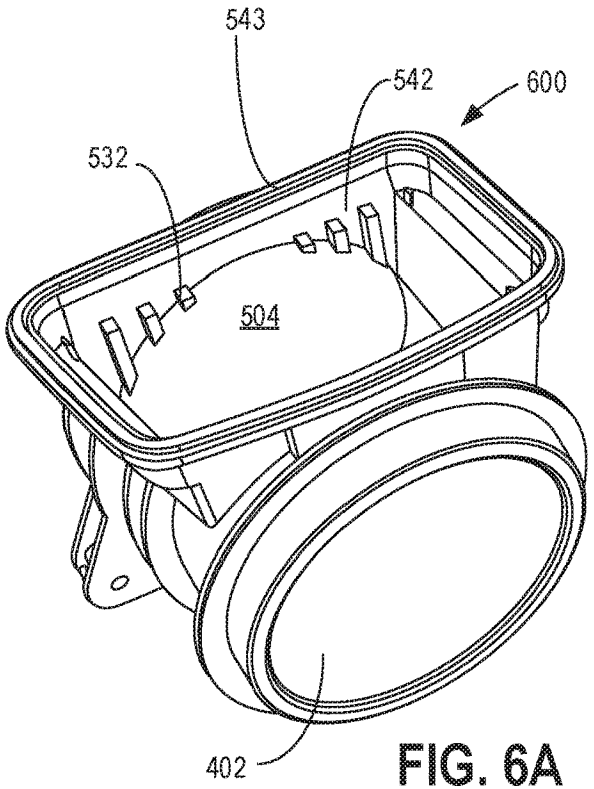

FIGS. 6A-6C show three separate views 600, 640, and 680 of the cavity 504 for housing the HC trap in the first embodiment of the HC trap assembly. In these views the HC traps are not coupled to the duct 306. An injection molded rectangular enclosure 542 with a rectangular rim 543 may be integrally formed around the cavity (as a single structure) to hold the HC trap system 308. The rim 543 may have rounded corners.

The two opposite long side walls of the enclosure 542 may include a plurality of finger ribs 532 on the inner side of the respective wall. In one example, each wall may include six finger ribs 532 with three on one side and another three on another side with a gap in between. Two lands 544 may be positioned on two opposite short side walls of the enclosure 542. Each of the two lands may have a rectangular wall facing the ribs 532 and an arcuate wall adjacent to the respective side short wall. The finger ribs may be of unequal height with the ribs closer to the edge being larger than the ribs closer to the center. The ribs may provide stiffness and hold the HC trap within the cavity. In one example, the presence of the finger ribs and cavity volume may reduce noise and vibrations in the intake system. Further, the thickness, volume, and volume partition of the enclosure 542 may be adjusted for acoustic tuning and improvement of noise and vibrations in the intake system.

Figure 7A:
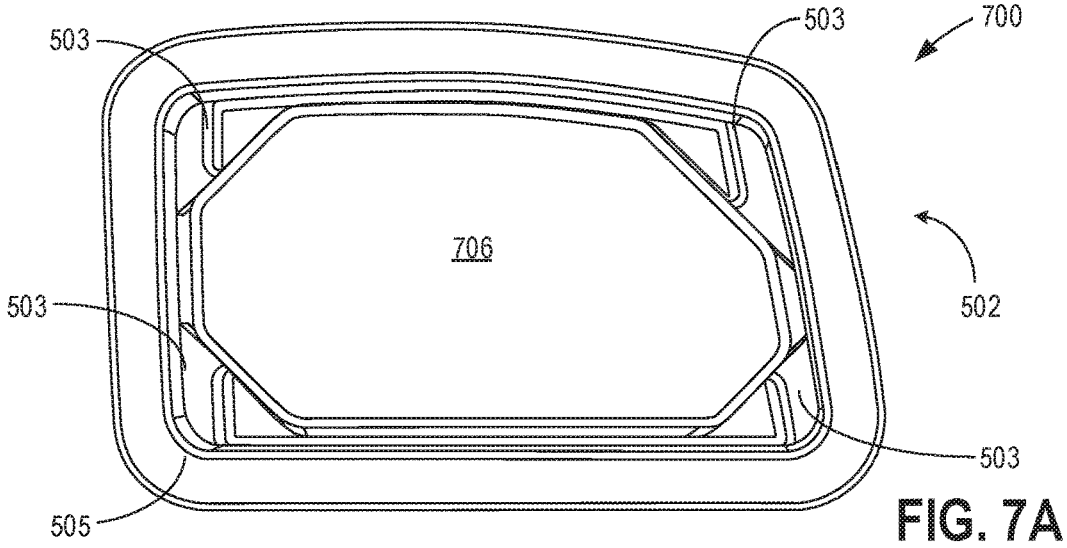
FIG. 7A-7C show a retention cap placed on a pillow-case type HC trap.
Figure 7B:
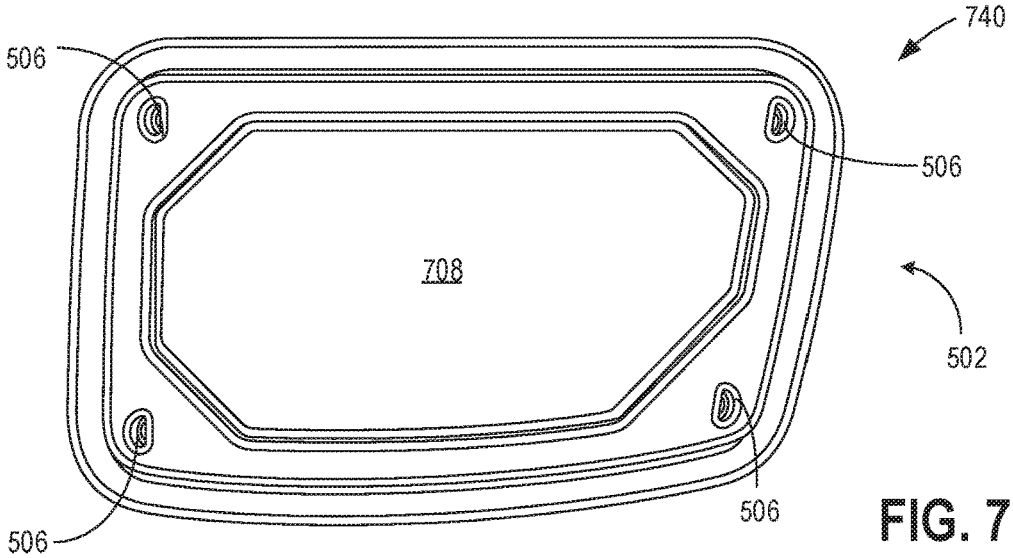
Figure 7C:
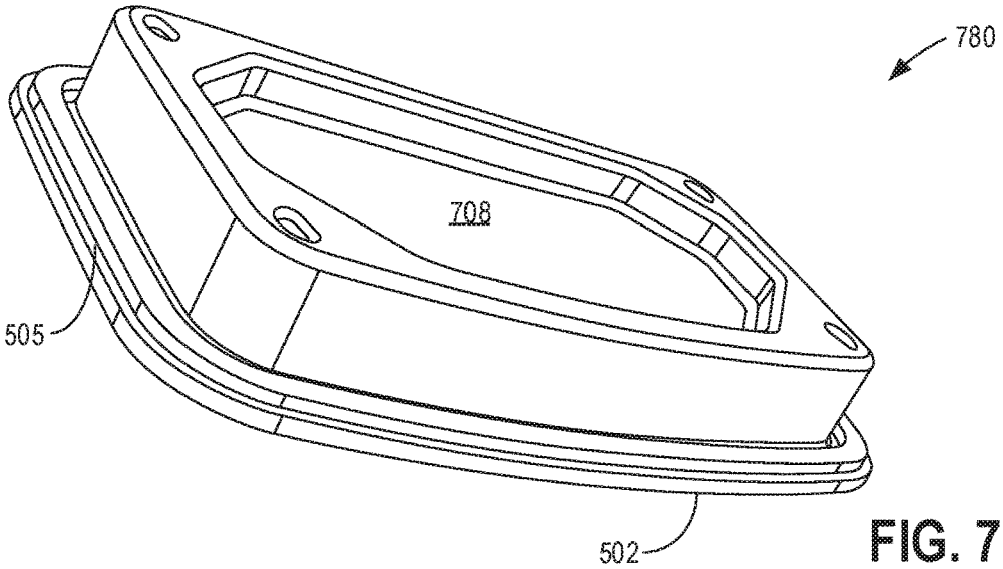

FIG. 7A shows an outer view 700 (viewed from outside the duct housing the HC trap) of a retention cap 502 placed on a pillow-case type HC trap. FIG. 7B shows an inner view 740 (viewed from inside the duct housing the HC trap) of the retention cap 502. FIG. 7C shows a perspective inner view 780 of the retention cap 502.

The outer surface 706 of the cap 502 may include a central portion and four triangular depressions 503 formed on the surface of the cap 502 at the four corners. A rectangular rim 505 with rounded edges may outline the edge of the cap 502. The rim 505 may be elevated relative to each of the central portion of the cap 502 and the depressions 503 on the outer surface 706 of the cap.

When viewed from inside the duct, the inner surface 708 may include four dents 506 at the four corners for engaging the positioning pins (formed on the cavity in which the HC trap is housed) during the poke-yoke assembly of the HC trap within the cavity. Upon coupling of the cap 502 to the HC trap assembly, the pillow-case type HC trap may be positioned in contact with the central portion inner surface 708.

Upon coupling of the HC trap along with the cap to the cavity, ends of each of the four pins may rest (or have a slight clearance to) the four dents 506. The depressions 503 may allow the cap to be welded on to the HC trap assembly without applying pressure on the pillow-case type HC trap (resting along the center of the inner surface). As an example, the cap may be coupled on top of the pillow-case type HC trap via adhesive thermobonding, heat staking, snap fit, twist lock, rivets, gasket with screw, gasket with snap clips, and/or welding (e.g., ultrasonic welding, hot plate welding, and infrared (IR) welding). In one example, plastic welding may be carried out using a hot plate and infrared weld joint. In the plastic welding method, a weld bead width and a flash trap width may be adjusted based on wall thickness and filler content. The cap may be injection molded, as a separate structure from the HC trap, using a polymeric material, resin such as polypropylene.

Figure 8A:
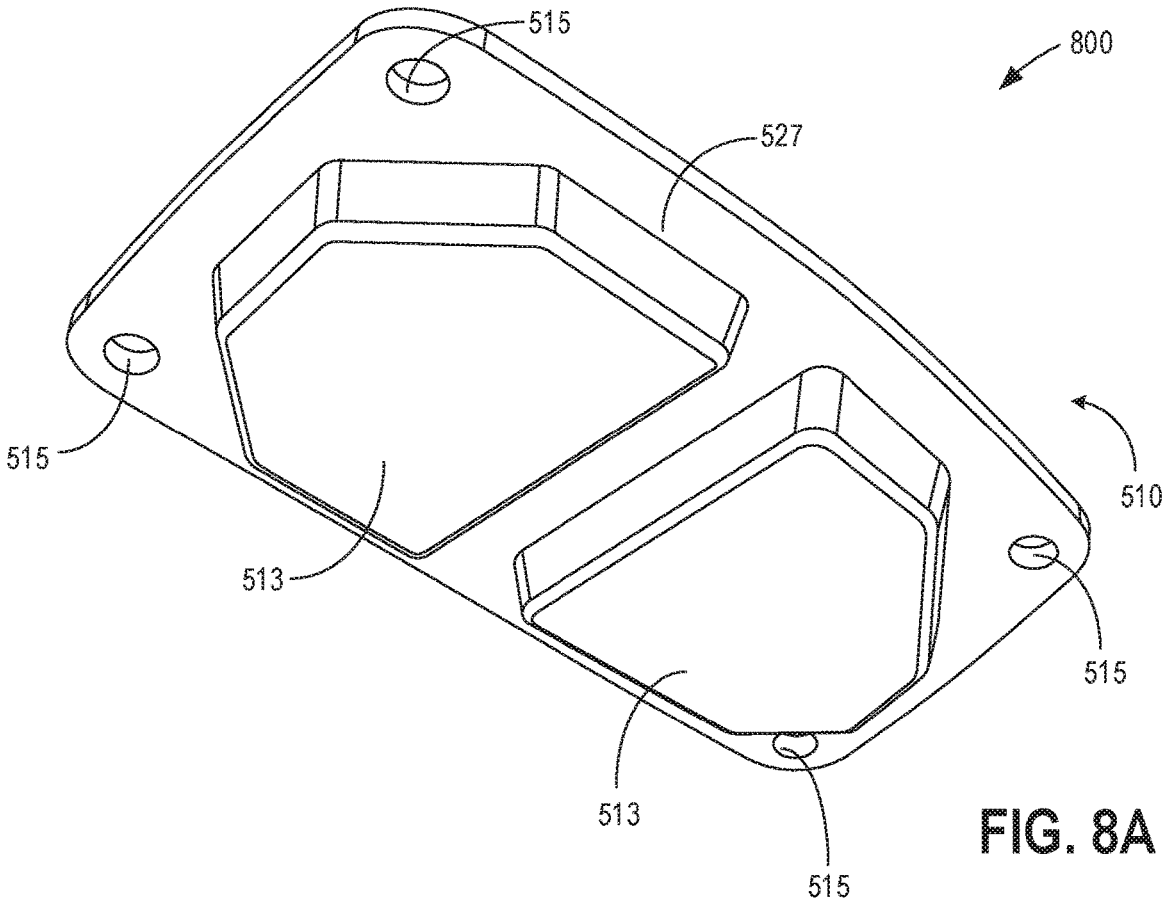
FIG. 8A-8B show the pillow-case type HC trap.
Figure 8B:
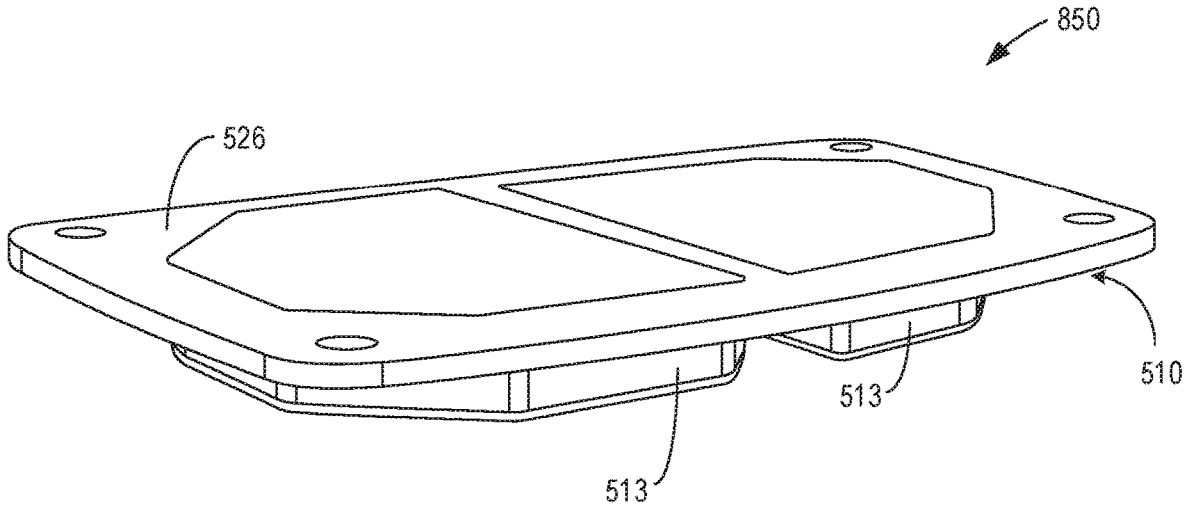

FIG. 8A shows a perspective view 800 of a pillow-case type HC trap 510 and FIG. 8B shows a top view 850 of the pillow-case type HC trap 510. The pillow-case type HC trap 510 may include a breathable base surface and two lobes 513 protruding out (from the base) forming a pillow-case type structure. In one example, the breathable base may be flat. In another example, the breathable base may be curved. The breathable base 526 may face the bore of the duct to which the HC trap is coupled while a second surface 527 may be covered by a cap (not shown). Two lobes 513 containing the HC adsorbent material formed on the flat surface 527 may protrude outward away from the cavity holding the HC trap. In one example, there may be one or more lobes and the lobes may protrude outward or inward from the flat or curved surface. There may be a ridge formed between the two lobes 513. There may be four holes 515 at the four corners of the HC trap to engage with the corresponding pins located at four corners of the cavity or the cap.

The breathable surface 526 may face the air flow thorough the duct and the HC adsorbing material inside the two lobes may adsorb any HC from the airstream. The breathable surface 526 may comprise a foam (e.g., open cell foam), a breathable fabric (e.g., non-woven polyester), and/or a carbonized flat sheet media, etc. in some examples. The lobes 513 may be made of a polymeric material, resin such as polypropylene, in some examples. Furthermore, the hydrocarbon adsorption layer may comprise activated carbon, in some examples.

The lobes 513 may be coupled to the breathable surface 526 via adhesive thermobonding, heat staking, snap fit, twist lock, rivets, gasket with screw, gasket with snap clips, and/or plastic welding (e.g., ultrasonic welding, hot plate welding, and infrared (IR) welding). Additionally, the hydrocarbon adsorption layer may be coupled to the lobes 513 via an adhesive (e.g., spray adhesive), sew stitching, thermobonding, heat staking, and/or welding (e.g., ultrasonic welding, hot plate welding, IR welding). Coupling the hydrocarbon adsorption layer to the second surface 527 and or breathable surface 526 may reduce the relative motion of the hydrocarbon adsorption layer, thereby decreasing attrition of a loose hydrocarbon adsorption layer.

In this way, the HC trap may include a flat, surface with two lobes protruding outward, the singular or plurality of lobes enclosing a hydrocarbon adsorbent material, wherein the flat surface is made of a breathable material allowing fluidic accumulation between the hydrocarbon adsorbent material and fluid passing through the duct.

Figure 9A:
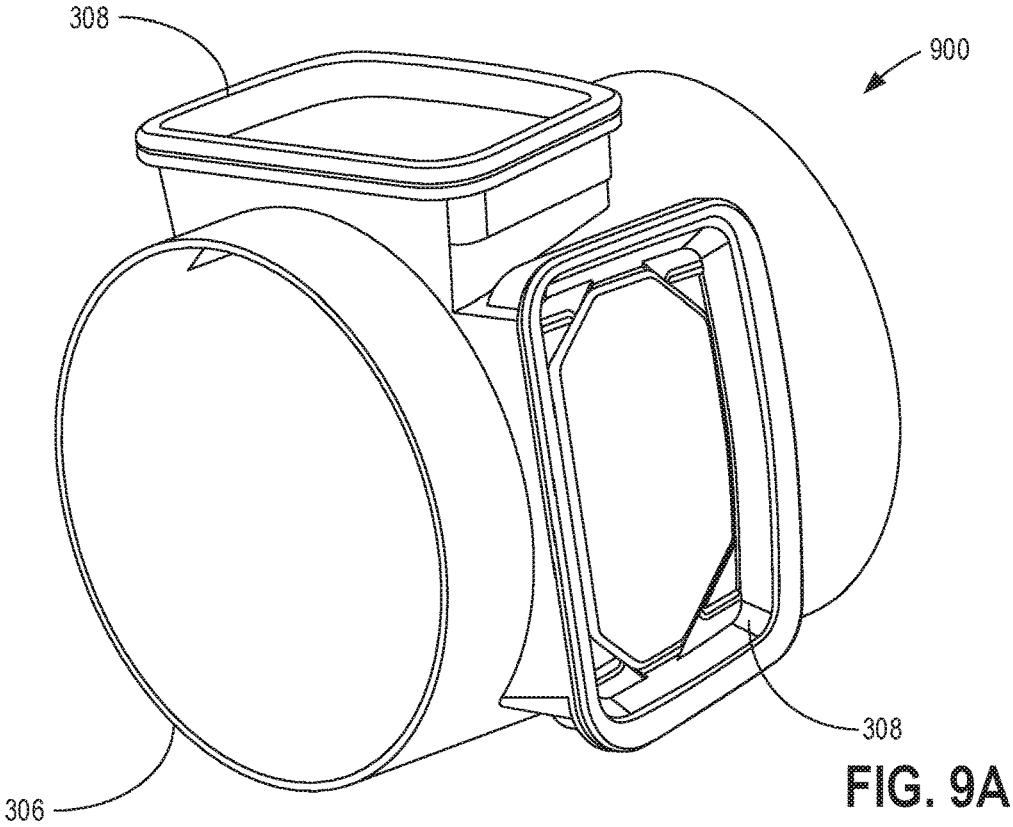
FIG. 9A-9B show a second embodiment of the HC trap assembly shown in FIG. 2.
Figure 9B:
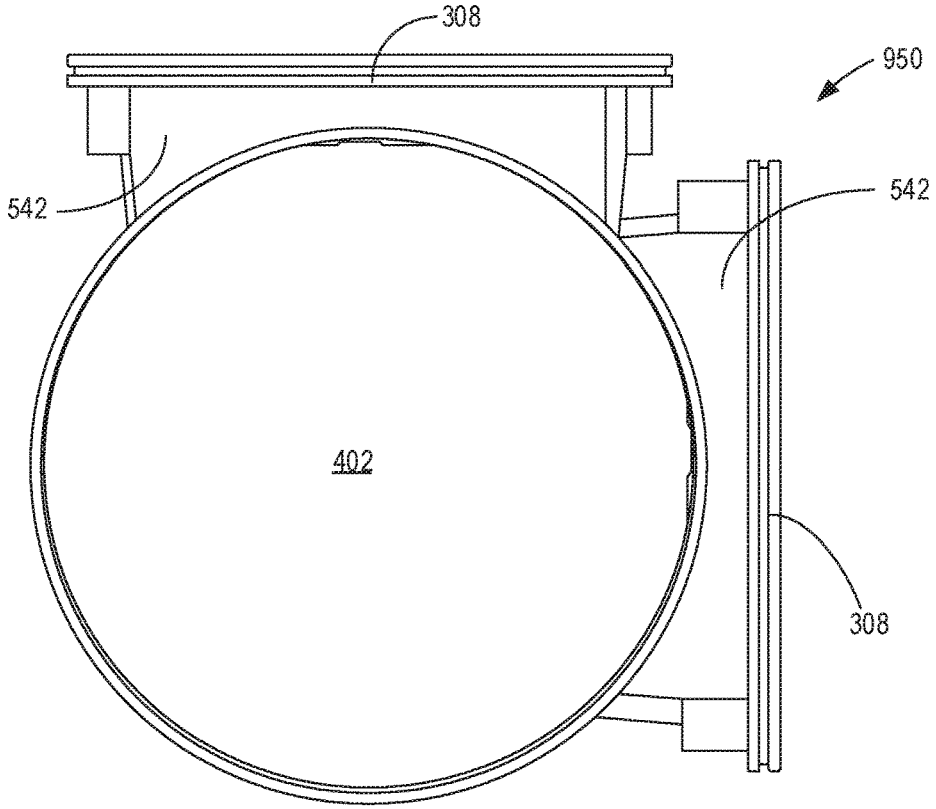

FIG. 9A shows a perspective view 900 of a second embodiment of the HC trap assembly shown in FIG. 2 and FIG. 9B shows a front view 950 of the second embodiment of the HC trap assembly. In this embodiment, two HC trap systems 308 may be coupled to a single duct 306. The duct 306 may be at the outlet of an air cleaner box of an engine air induction system.

The duct 306 may include two separate cavities integrally molded along the wall each accommodating a HC trap system 308. Each cavity may include features of cavity 504 as discussed in relation to FIGS. 6A-6C. Injection molded rectangular enclosures 542 may be structurally formed around each cavity to support the respective HC trap system 308. Each of the two HC trap systems may include a pillow-case type HC trap (such as HC trap 510 as discussed in detail in relation to FIGS. 8A-8B), flat sheet media, or other HC trap media/styles covered by a retaining cap (such as cap 502 as discussed in details in relation to FIGS. 7A-7C).

In one example, the two HC trap systems 510 may be positioned next to each other. In another example, the two HC trap systems 510 may be positioned on opposite sides of the central bore 402. In yet another example, more than two HC trap systems may also be attached in series along the wall of the cylindrical duct 306.

Figure 10A:
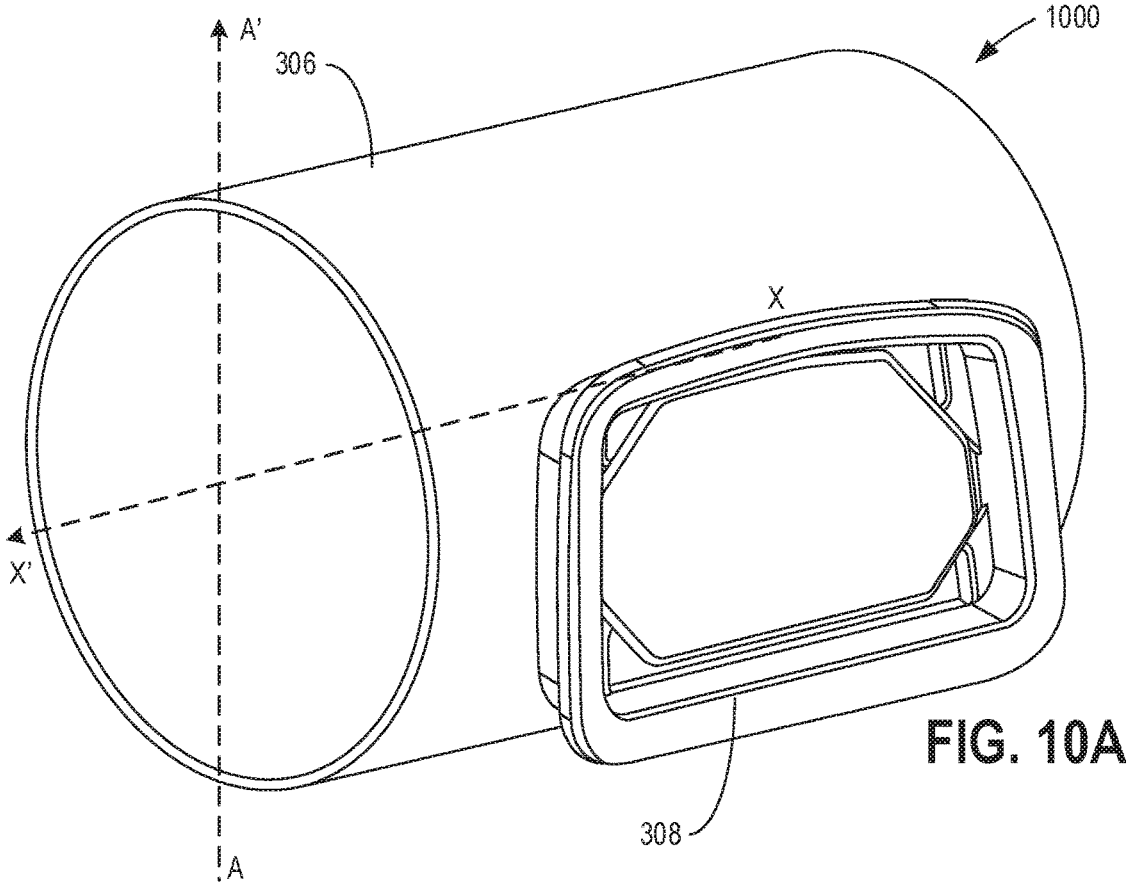
FIG. 10A-10B show a first orientation for a third embodiment of the HC trap assembly shown in FIG. 2.
Figure 10B:
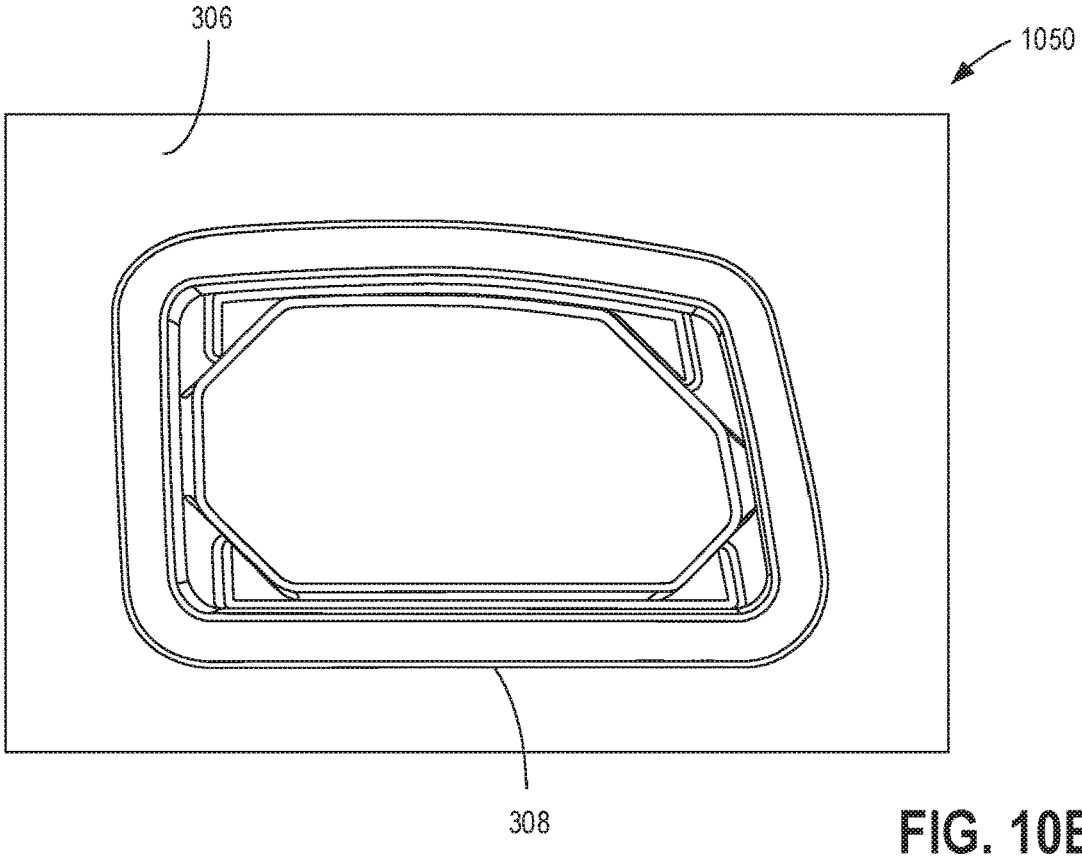

FIGS. 10A-10B show a first orientation 1000 for a third embodiment of the HC trap assembly shown in FIG. 2. In this orientation, the long side of the rectangular HC trap system 308 may align along the length of the duct 306 while the short side of the rectangular HC trap system 308 may align with the diameter of the duct 306. Said another way, the long side of the rectangular HC trap system 308 may be parallel to the central axis X-X' of the duct 306 while the short side of the rectangular HC trap system 308 may be parallel to the vertical axis A-A'.

Figure 11A:
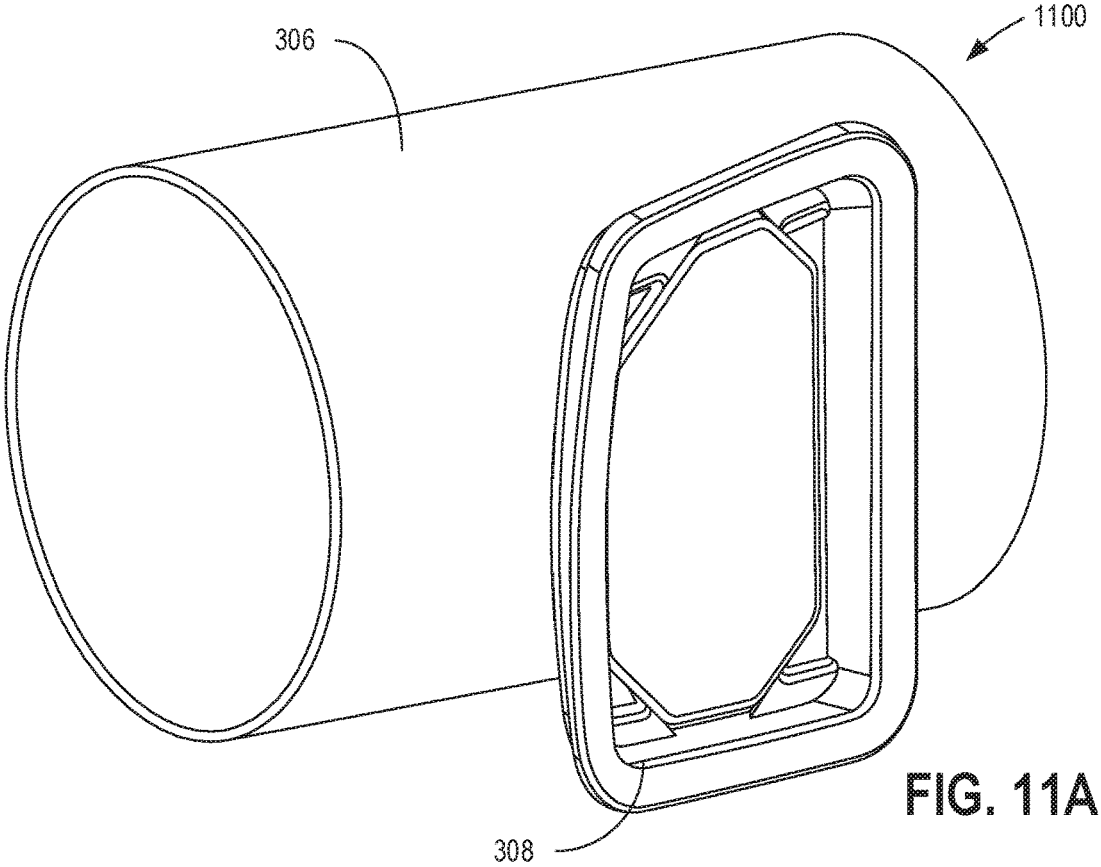
FIG. 11A-11B show a second orientation for the third embodiment of the HC trap assembly shown in FIG. 2.
Figure 11B:
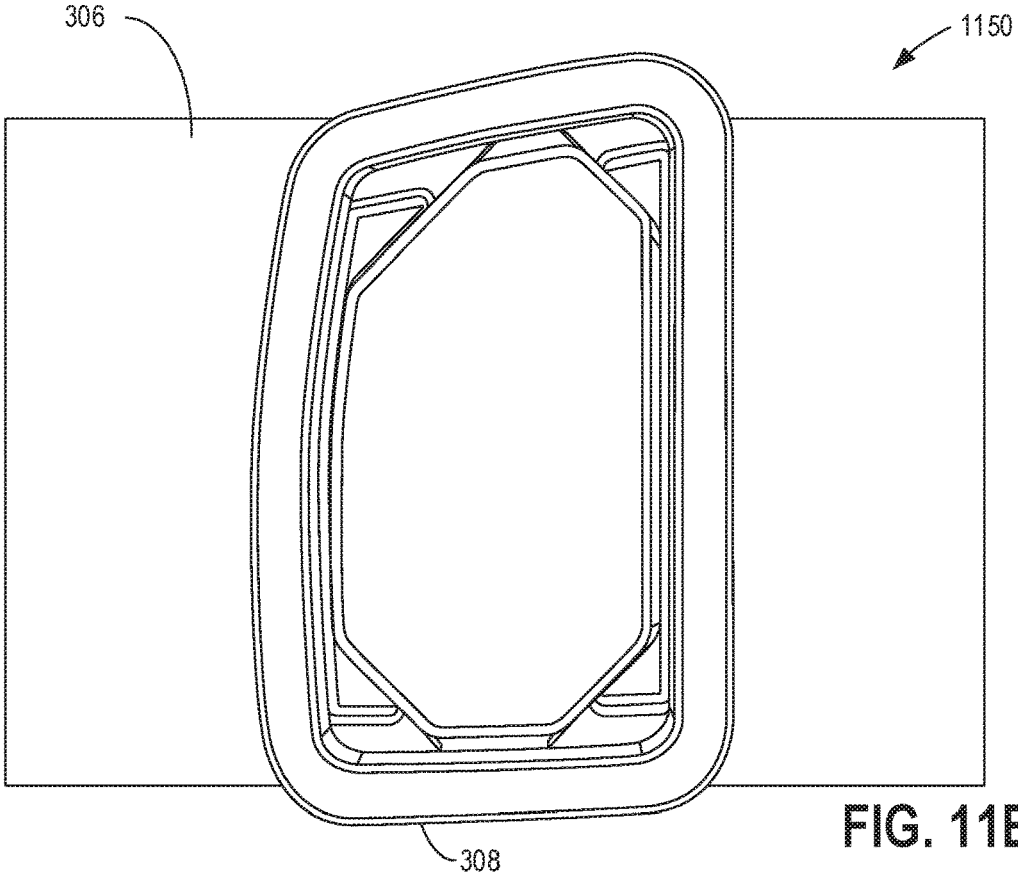

FIGS. 11A-11B shows a second orientation 1100 for a third embodiment of the HC trap assembly shown in FIG. 2. In this orientation, the short side of the rectangular HC trap system 308 may align along the length of the duct 306 while the long side of the rectangular HC trap system 308 may align with the diameter of the duct 306. Said another way, the short side of the rectangular HC trap system 308 may be parallel to the central axis X-X' of the duct 306 while the long side of the rectangular HC trap system 308 may be parallel to the vertical axis A-A'.

Figure 12A:
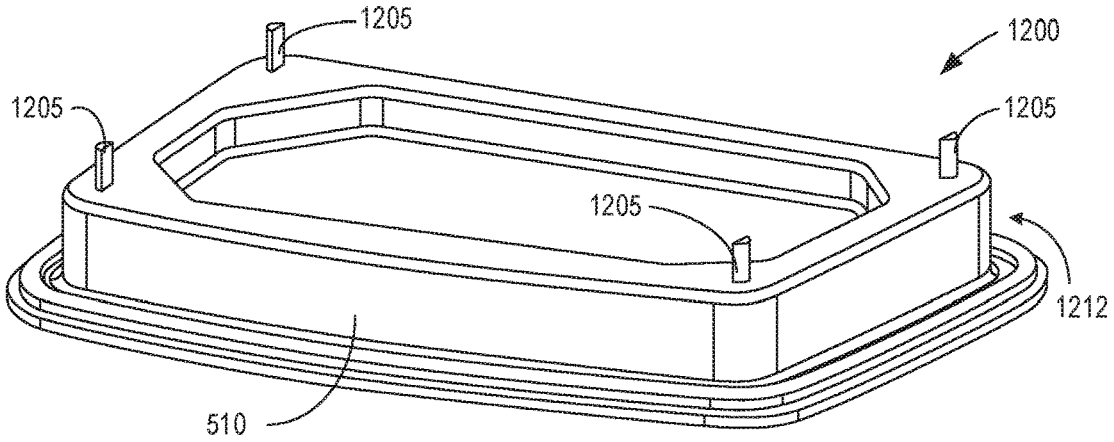
FIG. 12A-12D show a fourth embodiment of the HC trap assembly shown in FIG. 2.

FIG. 12A shows an outer view 1200 (viewed from outside the duct housing the HC trap) of a retention cap placed on a pillow-case type HC trap 510 in a fourth embodiment of the HC trap assembly shown in FIG. 2. All features of the retention cap 1212 are the same as that of the retention cap 502 as discussed in FIGS. 7A-7C (the common features are numbered similarly and not reiterated) except that the retention cap 1212 may include four pins 1205 at the four corners of the rectangular cap for engaging with corresponding holes in the pillow-case type HC trap during assembly of the HC trap system.

The pins 1205 on the cap 1212 may replace the pins present in a cavity of a duct (wherein the HC trap system is coupled) and the cavity may include four corresponding depressions (or holes) into which the pins may be inserted upon assembly of the pillow-case type HC trap and the retention cap 1212 within the cavity of the duct at the outlet of an air cleaner box. The HC trap 510 may be pre-assembled with the retention cap 1212 by using staking, etc. prior to attachment of the HC trap 510 to the duct.

Figure 12B:
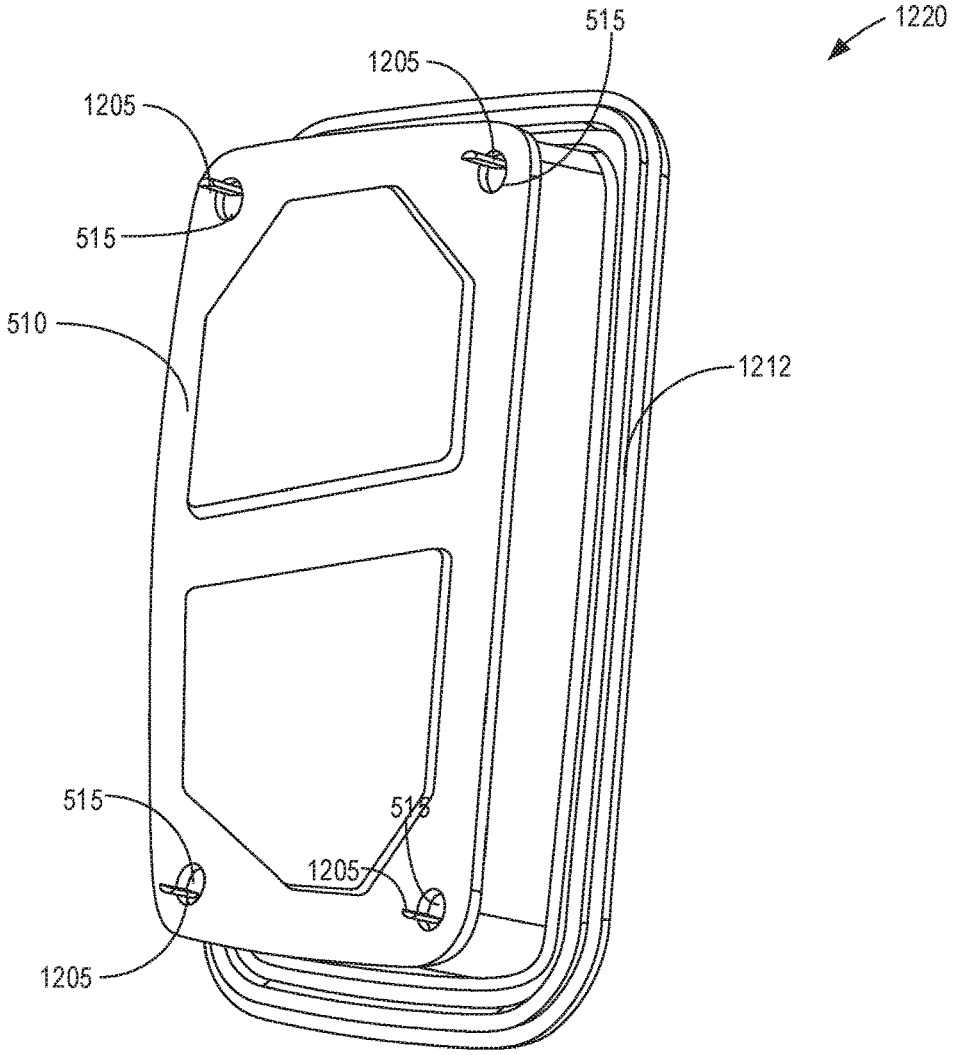

FIG. 12B shows a HC trap system 1220 including a pillow-case type HC trap 510 and a retention cap 1212 in the fourth embodiment of the HC trap assembly. All features of the HC trap 510 are same as that of the HC trap 510 as discussed in FIGS. 8A-8C and are not reiterated. The four pins 1205 at the four corners of the retention cap 1212 may be inserted into corresponding holes 515 at the four corners of the rectangular pillow-case type HC trap. Upon assembly, the pins may engage with features such as finger ribs within a cavity of a duct on which the HC trap system may be assembled in a poke-yoke arrangement.

Figure 12C:
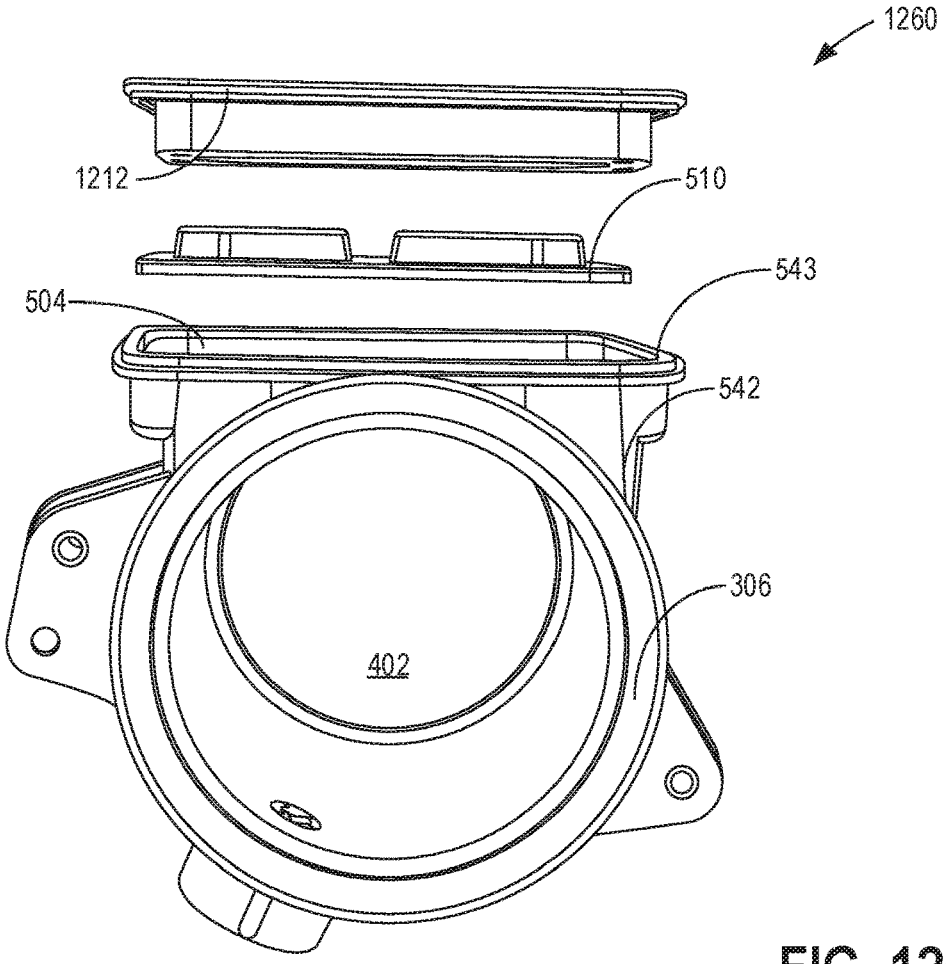

FIG. 12C shows an expanded view 1260 of the fourth embodiment of the HC trap system 308. In this view, the pillow-case type HC trap 510 and the adjoining retention cap 1212 are separated from the cavity 504 formed on the side wall of the duct 306. A rectangular enclosure 542 may be injection molded on the cavity providing support for HC trap engagement. The enclosure 542 may include a rectangular rim 543 around the edge of the enclosure 542, thereby defining a rectangular opening for HC trap attachment. A plurality of finger ribs may be formed on the side walls of the enclosure 542 to enable engagement of the pillow-case type HC trap 510 within the cavity 504. The dimensions of the finger ribs may vary over a range of sizes and shapes with some ribs being larger and/or wider than others. The retention cap 1212 may include four pins (not shown) located at four corners to enable attachment of the pillow-case type HC trap 510 and the cap 1212 inside the cavity 504.

Figure 12D:
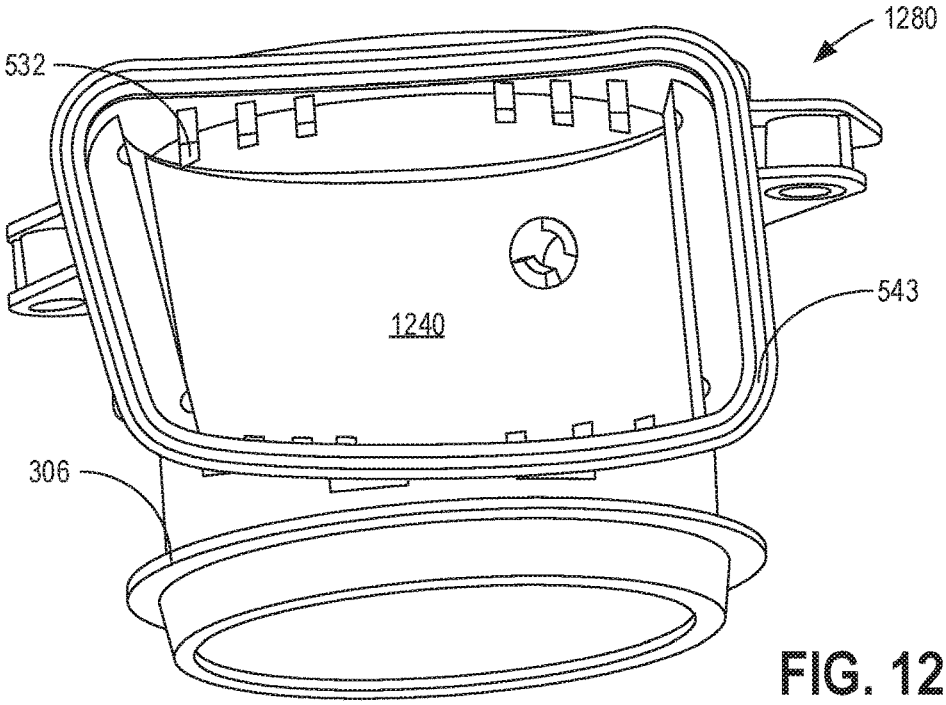

FIG. 12D shows a front view 1280 of the cavity 1240 for housing the HC trap in the fourth embodiment of the HC trap assembly. In this view the HC trap system is not coupled to the duct 306. All features of the cavity 1240 are same as that of the cavity 504 as discussed in FIGS. 6A-6C (the common features are numbered similarly and not reiterated) except that the cavity 1240 1212 may not include four pins at the four corners. The pins for engaging the HC trap with the retention cap and the cavity may be present in the four corners of the retention cap instead of the cavity. In this way, a set of pins may be included in either the cavity or the retention cap to engage with corresponding holes housed in the HC trap during assembly of the HC trap system.

FIG. 13A shows a front view 1300 of a fifth embodiment of the HC trap assembly 308 shown in FIG. 2. FIGS. 13B-13C show perspective views 1320 and 1340 of the fifth embodiment of the HC trap assembly 308 with a first frame arrangement. In this embodiment, the HC trap system 308 is coupled into a pocket formed within a duct 306 at the outlet of an air cleaner box of the engine air induction system. A bore 402 of a duct 306 may be divided into two hollow sections 402*a* (first section) and 402*b* (second section) by an injection molded frame 1303 (also referred herein as a bracket). The frame 1303 may be integrally part of a single structure with the duct 306. In the first enclosure arrangement, the frame 1303 may include a rectangular upper part 1304 and a rectangular lower part 1305 each coupled to the inner side of the duct 306 wall. The frame 1303 may be parallel to a vertical axis of the duct and may form a chord of the circular bore 402 of the duct 306. In one example, the first section 402*a* may include 70% of the total area within the bore 402 while the second section 402*b* may include a remaining 30% of the total area within the bore 402.

A HC trap system 308 may be positioned within the upper part 1304 and the lower part 1305 of the frame 1303. Each of the upper part 1304 and the lower part 1305 may include a u-shaped slot with one end open and another end sealed. A HC trap system 308 may include a pillow-case type HC trap 510 (such as HC trap 510 as discussed in relation to FIGS. 8A-8B) and a retention cap 502 (such as retention cap 502 as discussed in relation to FIGS. 7A-7C).

The HC trap system 308 may be inserted (slid) into the slot formed by each of the upper part 1304 and the lower part 1305 of the frame 1303. The dimension of the long side of the rectangular HC trap system 308 may be equal to the distance between the upper part 1304 and the lower part 1305 of the frame 1303. Therefore, upon positioning the HC trap system 308 within the slot, the HC trap system 308 may be snugly held within the bore 402 of the duct 306. The breathable surface of the pillow-case type HC trap may face the air flow through the first section 402*a* of the duct. While the retention cap 502 (coupled to the HC trap 510) may be facing the second section 402*b* of the duct. Alternatively a Flat Sheet or Paper Media may be attached to a frame which may be slid into the slot.

FIG. 13D-13E show perspective views 1360 and 1380 of the fifth embodiment of the HC trap assembly 308 with a second frame arrangement. In the first enclosure arrangement, the frame 1303 may include two separated components, the upper part 1304 and the rectangular lower part 1305 while in the second frame arrangement, the frame 1315 may be a single structure. The frame 1315 may be a C-shaped structure including a lower part coupled or integrally molded to an inner side of the duct 306 wall, an upper part coupled to an inner side of the duct 306 wall, and a connecting arm coupling the lower part and the upper part. Each of the lower part, the connecting arm, and the upper part of the single piece frame 1315 may include an open end and a closed end, thereby forming a u-shaped slot running throughout the frame. Alternatively, the HC trap may be attached or integrally molded to the frame and separately slid in and attached or trapped to the internal bore.

The HC trap system 308 may be slid into the slot formed by each of the lower part, the connecting arm, and the upper part of the frame 1315. The dimension of the long side of the rectangular HC trap system 308 may be equal to the distance between the upper part and the lower part of the frame 1303. Therefore, upon positioning the HC trap system 308 within the slots, the HC trap system 308 may be inserted into the upper part, the connecting arm, and the lower part of the frame 1315 and the trap may be snugly retained within the bore 402 of the duct 306. The breathable surface of the pillow-case type HC trap may face the air flow through the first section 402*a* of the duct while the retention cap 502 (coupled to the HC trap 510) may be facing the second section 402*b* of the duct. In an alternate embodiment, the breathable surface may be reversed to face the first section 402*a*.

In this way, a hydrocarbon (HC) pillow-case type trap may be inserted in a slot formed in a frame positioned within a cylindrical bore of a duct of an engine air induction system, the frame and the duct injection molded as a single structure. In a first configuration, the frame may be a two piece structure including an upper part coupled to an inner surface of a wall of the duct and a lower part coupled to an inner surface of a wall of the duct, the slot formed within each of the upper part and the lower part while in a second configuration the frame may be a one piece structure including the upper part coupled to the inner surface of the wall, the lower part coupled to the inner surface of the wall, and a connecting arm joining or integrally molded into the upper part and the lower part, the slot formed within each of the upper part, the lower part, and the connecting arm.

Figure 14A:
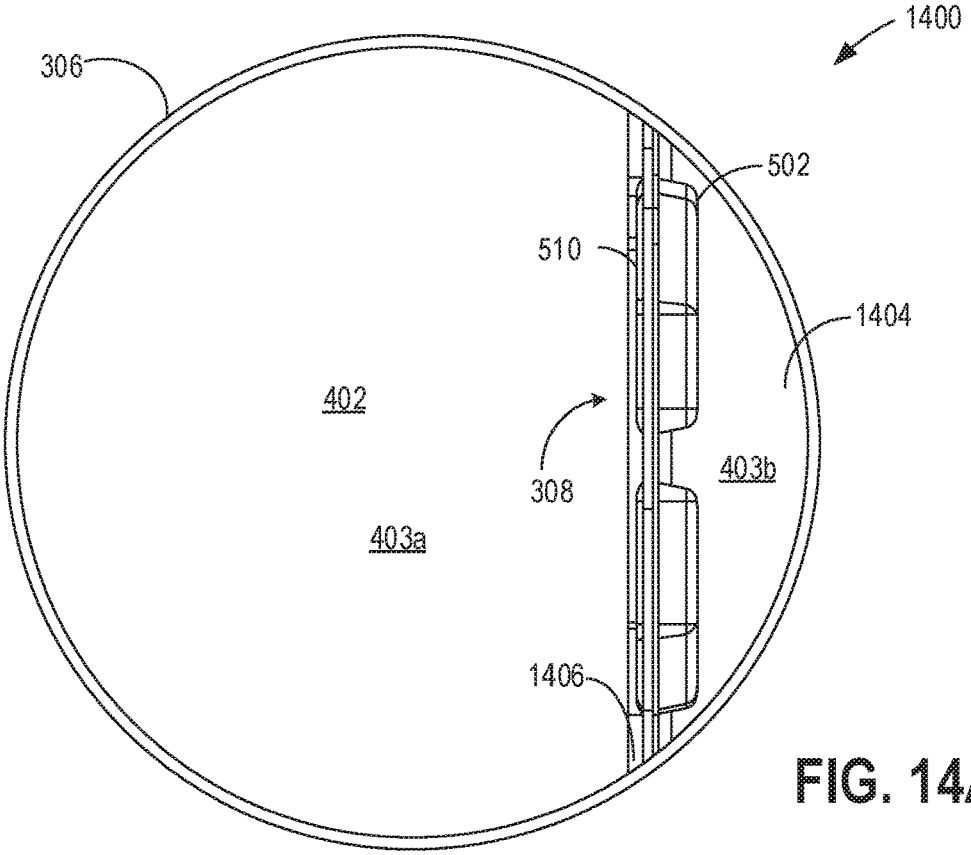
FIG. 14A-14E show a sixth embodiment of the HC trap assembly shown in FIG. 2.
Figure 14B:
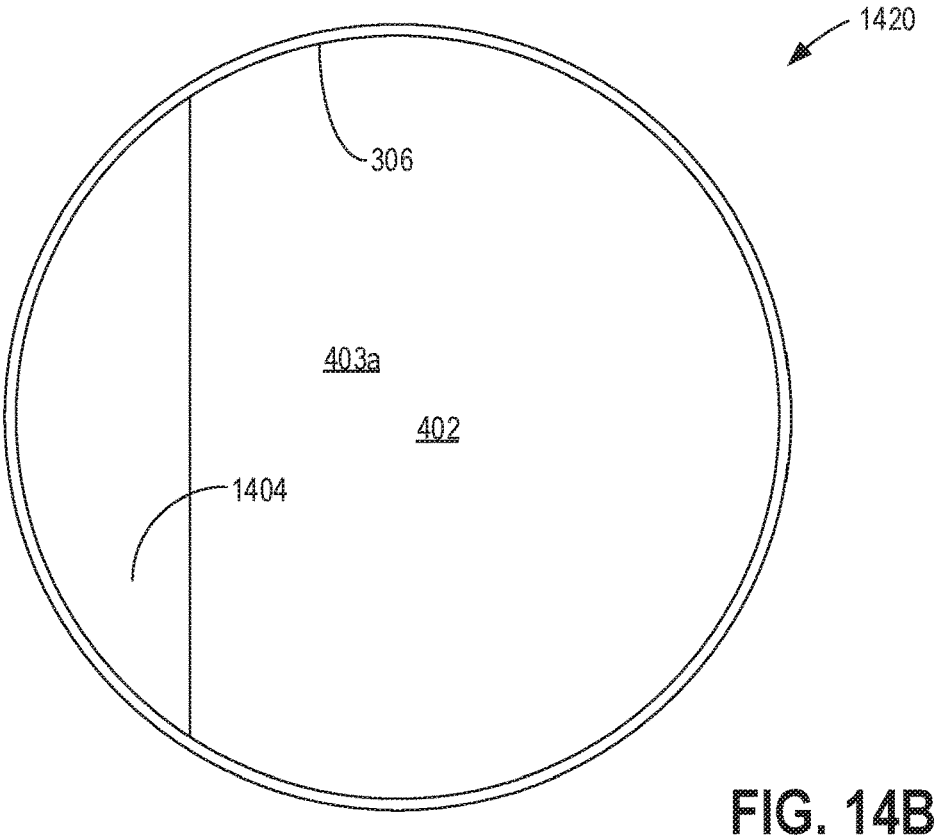
Figure 14D:
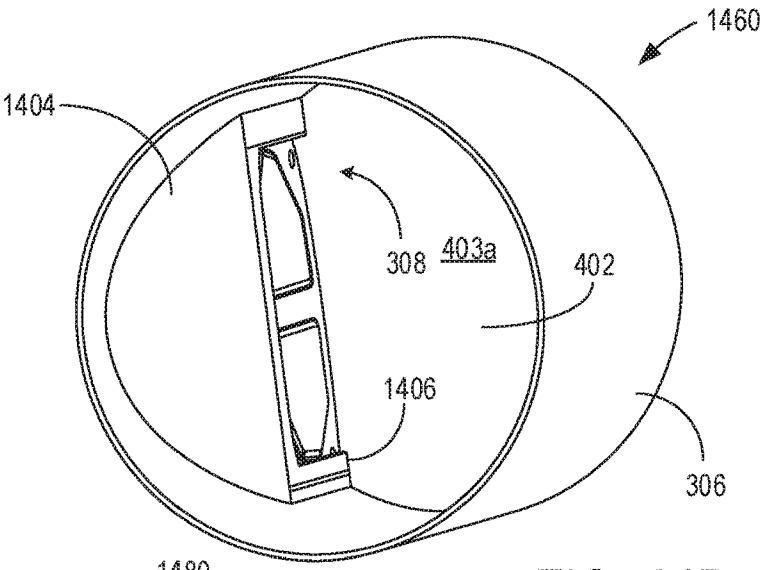
Figure 14E:
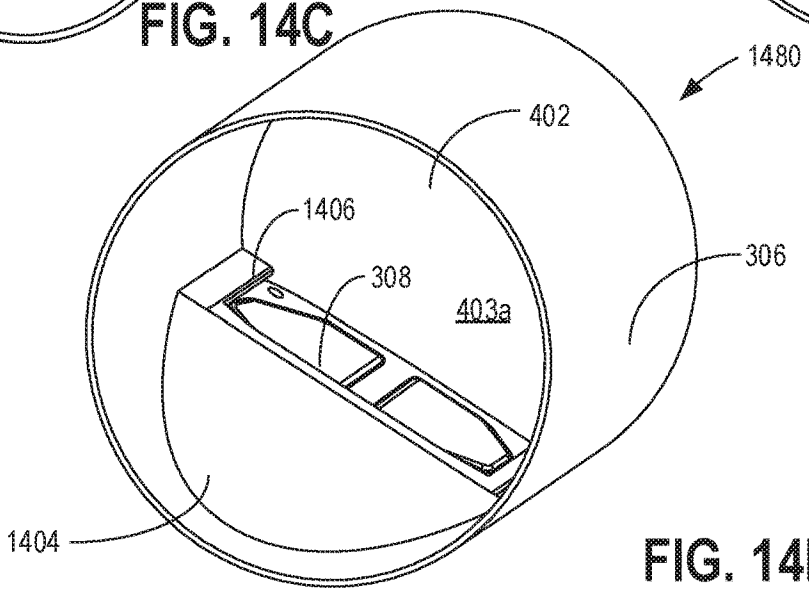
Figure 14C:
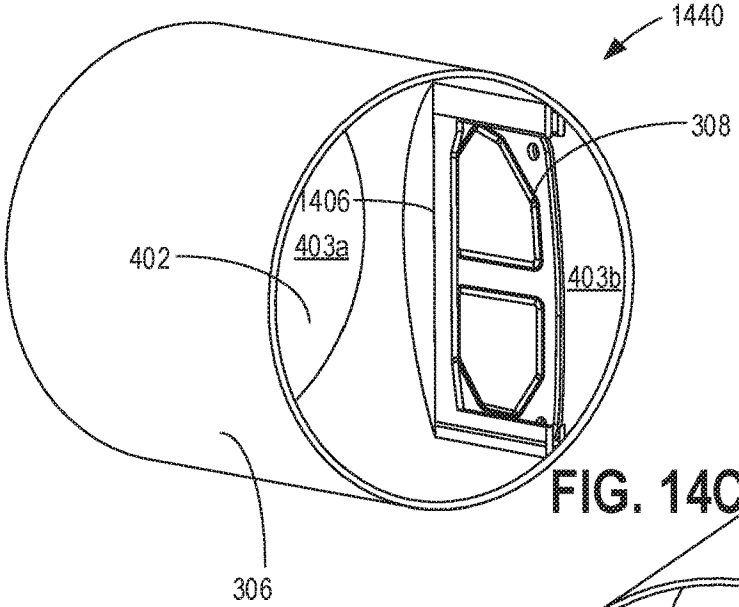

FIG. 14A shows a front view 1400 and FIG. 14B shows a rear view 1420 of a sixth embodiment of the HC trap assembly 308 shown in FIG. 2. FIGS. 14C-14E show perspective views 1440, 1460, and 1480 of the sixth embodiment of the HC trap assembly 308 shown in FIG. 2. In this embodiment, the HC trap system 308 is coupled to the inner wall of a duct 306 at the outlet of an air cleaner box of the engine air induction system. At the location of the HC trap system 308, a bore 402 of a duct 306 may be divided into two sections 403*a* and 403*b* by an integrally formed (injection molded) frame 1406. The frame 1406 may be part of the duct as a single structure.

A first section 403*a* may be hollow allowing flow of air through the duct while the second section 403*b* may be blocked via a shield 1404. The shield 1404 may cover a D-shaped area formed between the frame 1406 and the wall of the duct 306. The frame 1406 may be integrally or separately formed as a part of a single structure with the duct 306. The frame 1406 may be a C-shaped structure including a lower part coupled to an inner side of the duct 306 wall, an upper part coupled to an inner side of the duct 306 wall, and a connecting arm coupling each of the lower part and the upper part. Each of the lower part, the connecting arm, and the upper part of the single piece frame 1406 may include an open end and a closed end, thereby forming a u-shaped slot running throughout the frame. The shield 1404 may extend from the connecting arm of the frame 1406 to the wall of the duct 306, thereby covering the rear side of the HC trap assembly 308. The front of the HC trap assembly 308 may remain open allowing air to come in contact with the adsorbent material in the HC trap.

The HC trap system 308 may be slid into the slot formed by each of the lower part, the connecting arm, and the upper part of the frame 1406. The dimension of the long side of the rectangular HC trap system 308 may be equal to the distance between the upper part and the lower part of the frame 1406. Therefore, upon positioning the HC trap system 308 within the slots, the HC trap system 308 may be inserted into the upper part, the connecting arm, and the lower part of the frame 1406, and the trap may be snugly held within the bore 402 of the duct 306. The breathable surface of the pillow-case type HC trap may face the air flow thorough the first section 403*a* of the duct while the retention cap 502 (coupled to the HC trap 510) may face the second section 403*b* of the duct.

The difference between the fourth embodiment and the fifth embodiment of the HC trap assembly is that in the fourth embodiment, the shield 1404 is absent, thereby making the second section 402*b* hollow whereas in the fifth embodiment, upon coupling of the HC trap system 308 into the frame, an enclosed area (blocked on three sides) may be formed between the HC trap system 308, the wall of the duct 306, and the shield 1404.

Figure 15B:
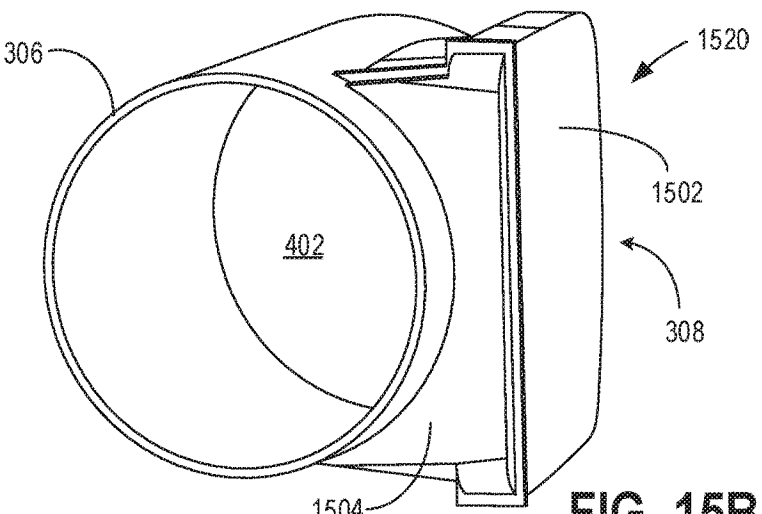
FIG. 15A-15D show a seventh embodiment of the HC trap assembly shown in FIG. 2.
Figure 15D:
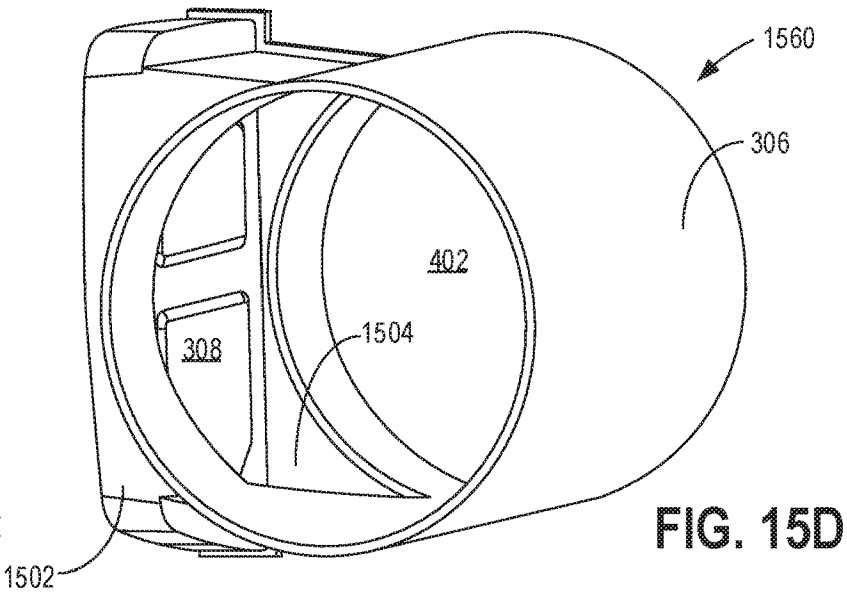
Figure 15A:
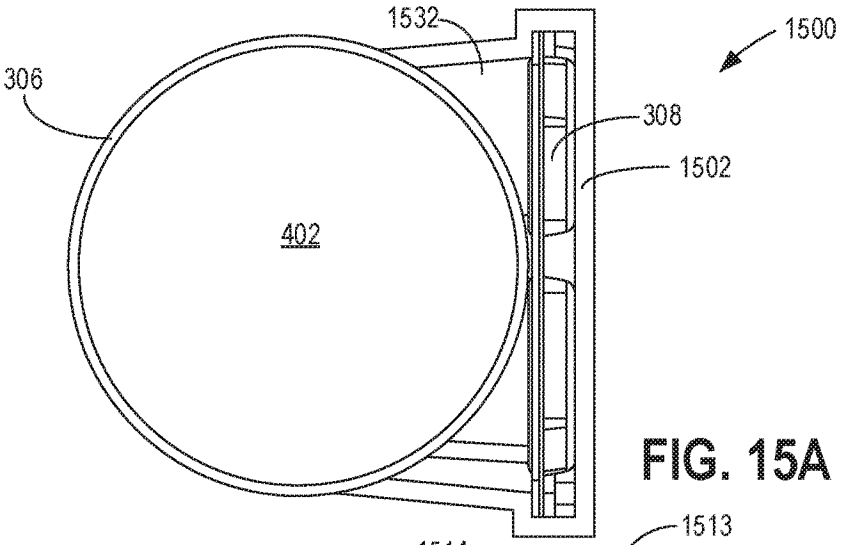
Figure 15C:
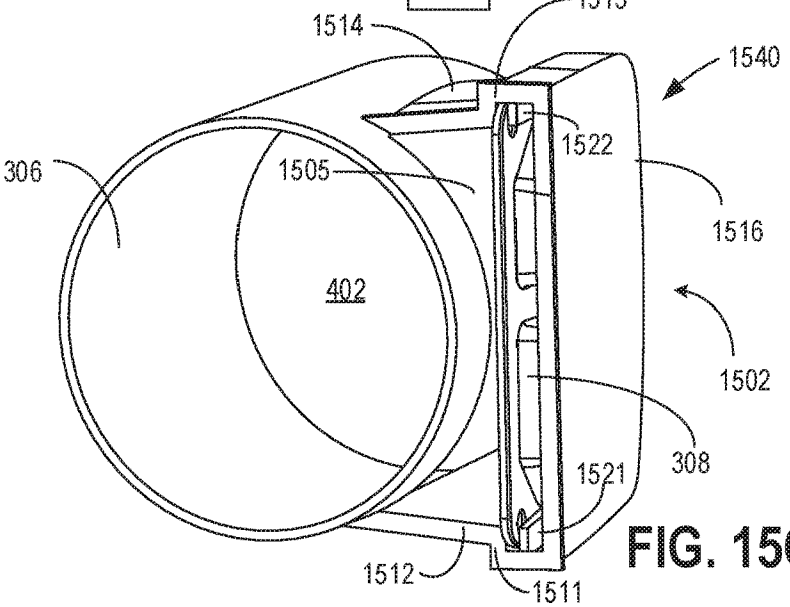

FIG. 15A shows a front view 1500 and FIGS. 15B-15D show perspective views 1520, 1540, and 1560 of a seventh embodiment of the HC trap assembly shown in FIG. 2. In the sixth embodiment, the HC trap system 308 may be coupled to the outer wall of a duct 306 at the outlet of an air cleaner box of the engine air induction system via a frame. A hollow window (also referred herein as side pocket or opening) may be formed on the wall of the duct 306 and the frame 1502 supporting a HC trap system 308 may be coupled to the window 1505 such that the air flowing through the duct is in fluidic communication with the HC trap system 308. The frame 1502 may be integrally part of a single structure with the duct 306 and the window 1505. The window may be parallel to a vertical axis of the duct 306.

The frame 1502 may be a three sided structure with the third side housing the HC trap system 308 facing the window 1505 in the duct wall. The first side 1512 and the second side 1514 of the frame 1502 may project outward from the window 1505 and the third side 1516 may vertically connect the first side 1512 and the second side 1514. There may be a first 1511 step at the junction of the first side 1512 and the third side 1516 and a second step 1513 at the junction of the second arm 1514 and the third side 1516. A first tab 1521 may be formed within the first step 1511 (on the inner wall) and a second tab 1522 may be formed within the second step 1513 (on the inner wall) to provide a slot for holding the HC trap system 308.

In this way, the frame 1502 may be protruding outward from an outer surface of the wall, the frame including a first side 1512, a second side 1514, and a third side 1516, the first side parallel to the second side and the third side parallel to a vertical axis of the duct, and each of the first side and the second side coupling the third side to the wall.

The HC trap system may be positioned in a slot (groove) formed by the first tab 1521, the second tab 1522, the first step 1511, and the second step 1513. A shield 1532 may cover an area formed between the frame 1502 and the wall of the duct 306 on a first side of the frame while the opposite, second side may be open for access to the HC trap system 308. The HC trap system 308 may be installed or removed from the second side of the frame. Upon assembly of the HC trap system 308 inside the frame, the second side may be covered via a permanent or detachable protective cap 1504 (also referred herein as protective cap). The protective cap 1504 may be coupled to the frame 1502 via a poke-yoke arrangement. In this way, a detachable or permanently affixed protective cap 1504 may be coupled on a first area between the third side 1516 and the wall on one side of the frame 1502 and an integrally formed shield 1532 covering an area between the third side and the wall on an opposite side of the frame 1502. Details of the protective cap is discussed with relation to FIGS. 16A-16B.

As discussed before, the HC trap system 308 may include a HC trap 510 (such as HC trap 510 as discussed in relation to FIGS. 8A-8B) and a retention cap 1502 (such as retention cap 510 as discussed in relation to FIGS. 7A-7C). The HC trap 510 may be a pillow case type trap, flat sheet media, or other HC trap media/style. In this way, the HC trap system 308 may be coupled to the exterior of an air induction system duct via a frame allowing easier assembly.

In this way, a system for a HC trap may include a duct coupled to an outlet of an air cleaner box in an engine air induction system, an opening integrally formed on a wall of the duct, a frame injection molded around the opening, and a pillow-case shaped hydrocarbon (HC) trap inserted into a groove formed within the frame.

Figure 16B:
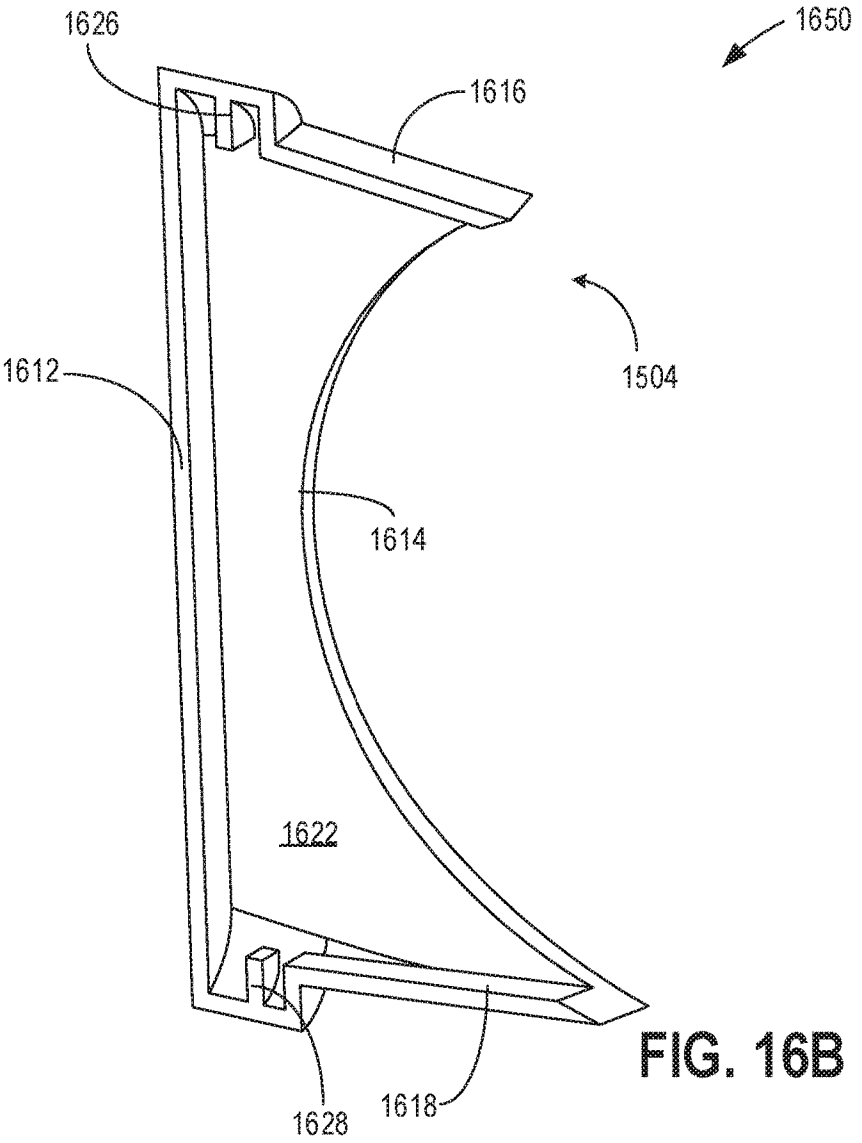
FIG. 16A-16B show a protective cap used in the seventh embodiment of the HC trap assembly.
Figure 16A:
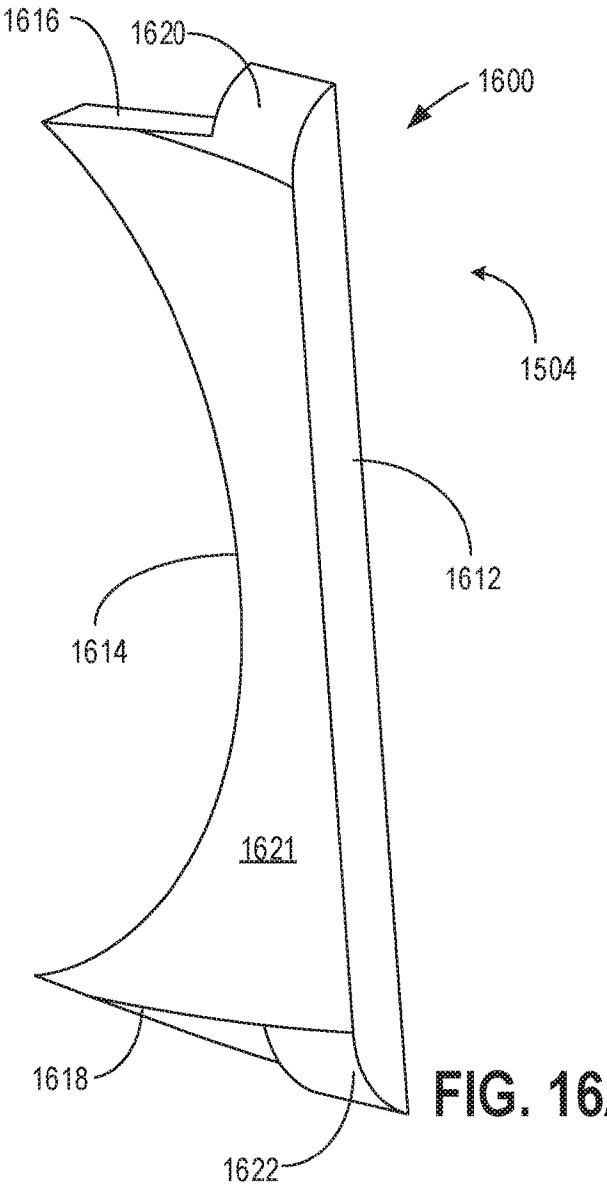

FIG. 16A shows a front view 1600 and FIG. 16B shows a back view 1650 of the protective cap 1504 of the seventh embodiment of the HC trap assembly as shown in FIG. 15A-15D. The protective cap 1504 may be attached and retained by snapping on, thermobonding, heat staking, twist locking, rivets, gasket with screw, gasket with snap clips, and/or welding (e.g., ultrasonic welding, hot plate welding, and infrared (IR) welding) over a frame coupled to a hollow window (opening) integrally formed in a duct of the air induction system, the frame supporting a HC trap system. The front view shows the outer surface 1621 while the back view shows the inner surface 1622 of the protective cap 1504.

The protective cap 1504 may be rectangular including a first arcuate edge 1614, a second straight edge 1612, a third straight edge 1618, and a fourth straight edge 1616. The first and the second edge may be longer than each of the third straight edge 1618, and the fourth straight edge 1616. The arcuate edge 1614 may be in contact with the curvature of the duct. A first protrusion 1620 and a second protrusion 1622 may project outward from the two ends (along the length of the straight edge 1612) of the protective cap 1504. The height of the protective cap 1504 may be uniform along the arcuate edge 1614 while the height of the protective cap 1504 may taper at both ends along the straight edge. Said another way, each of the first protrusion 1620 and the second protrusion 1622 may have tapering ends.

A first finger 1626 may be formed on the inner surface of the first protrusion 1620 and a second finger 1628 may be formed on the inner surface of the second protrusion 1622. Upon coupling of the protective cap 1504 onto the frame, the inner surface 1622 may face the HC trap system housed within the height.

Figure 17A:
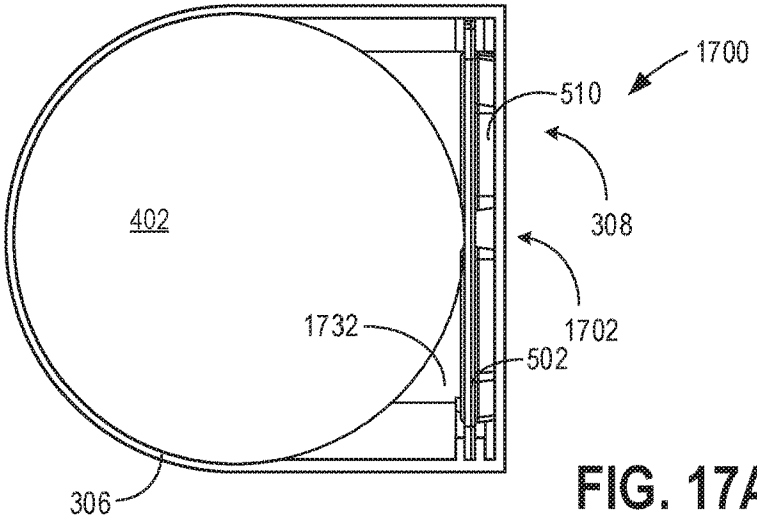
FIG. 17A-17D show an eighth embodiment of the HC trap assembly shown in FIG. 2.
Figure 17B:
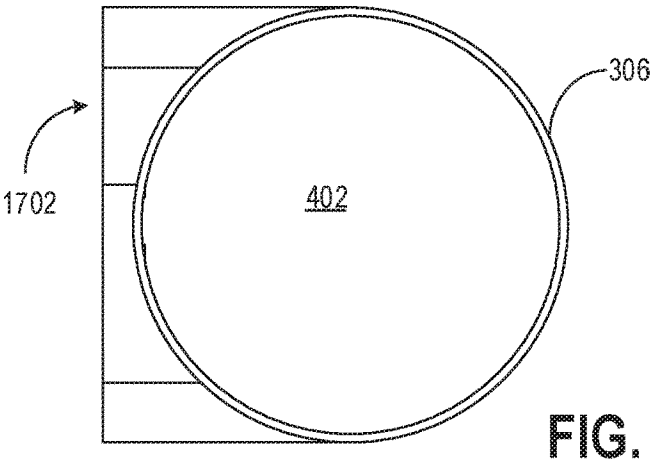
Figure 17C:
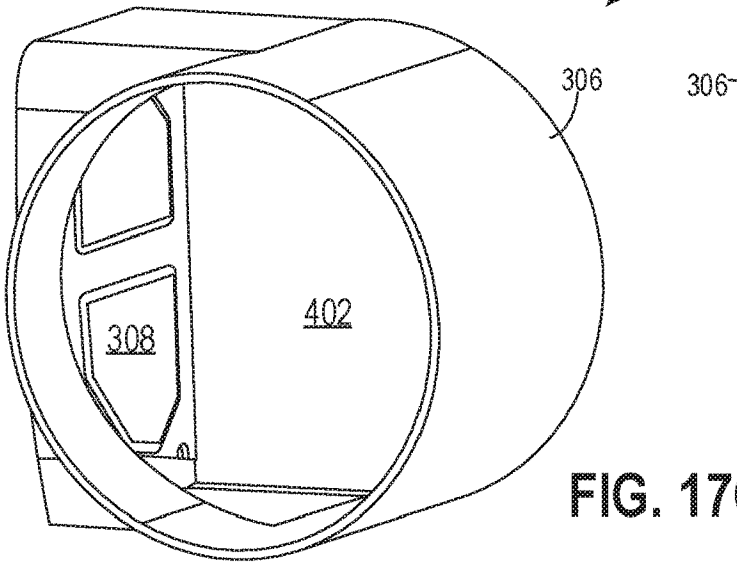
Figure 17D:
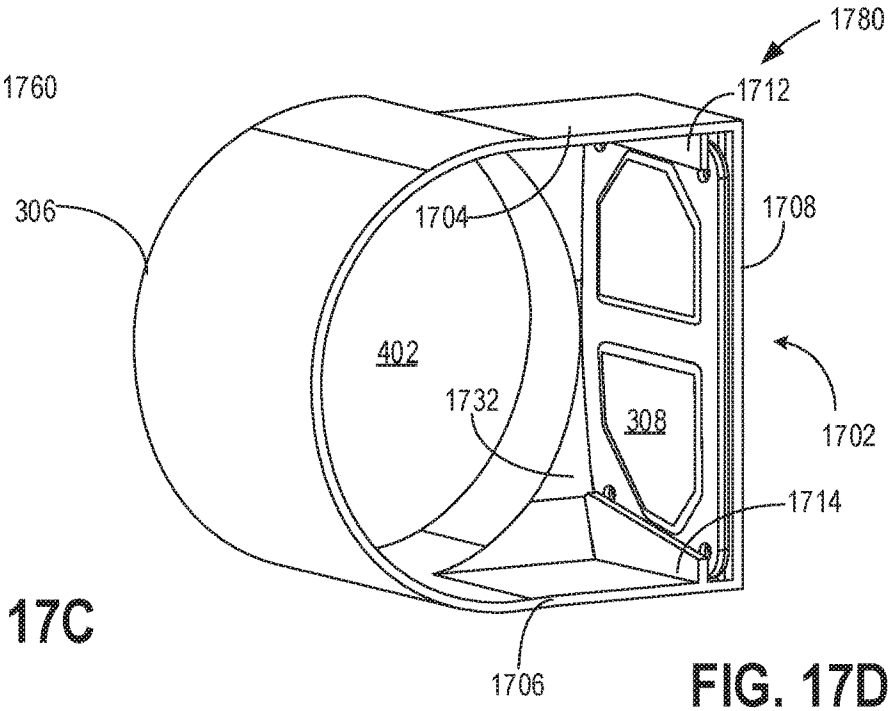

FIG. 17A shows a front view 1700, FIG. 17B shows a rear view 1720, and FIGS. 17C-17D shows perspective views 1760 and 1780 of an eighth embodiment of the HC trap assembly shown in FIG. 2. In the eighth embodiment, the HC trap system 308 may be coupled to the outer wall of a duct 306 at the outlet of an air cleaner box of the engine air induction system via a frame 1702. A portion of the wall of the duct 306 may be removed (cutout), and a frame 1702 supporting a HC trap system 308 may be injected molded around the cutout in the duct wall such that the air flowing through the duct is in fluidic communication with the HC trap system 308.

The frame 1702 may be a three sided structure with the third side housing the HC trap system 308 facing the cutout in the duct wall. The first side 1704 and the second side 1706 of the frame 1702 may project outward from the edges of the cutout while the third side 1708 may vertically connect the first side 1704 and the second side 1706.

The frame 1702 may include a short lower vertical wall 1714 (parallel to the third side 1708) and a short upper vertical wall 1712 (parallel to the third side 1708). In one example, each of the lower vertical wall 1714 and the upper vertical wall 1712 may be a percentage of the length of the third side 1708. Slots may be formed between the lower vertical wall 1714 and the third side 1708, and the upper vertical wall 1712 and the third side 1708. The HC trap system 308 may be slid into the slots formed by each of the lower vertical wall 1714, the upper vertical wall 1712, and the third side 1708. The breathable surface of the pillow-case type HC trap may face the cutout in the duct.

A shield 1732 may cover an area formed between the frame 1406 and the wall of the duct 306 on a first side of the frame while the opposite, a second side may be open for access to the HC trap system 308. The HC trap system 308 may be installed from the second side of the frame. Unlike the sixth embodiment of the HC trap assembly as shown in 15S. 15A-D, a protective cap may not be placed over the second side for easy access to the HC trap system 308. Elimination of the protective cap also simplifies the assembly process by eliminating the manufacturing and attachment of a protective cap to the air conduit. Similar to previous discussed embodiments, the HC trap system 308 may include a HC trap 510 (such as a pillow case type trap, flat sheet media, or other HC trap media/style, the pillow case type trap 510 being discussed in relation to FIGS. 8A-8B), and a retention cap 502 (such as retention cap 502 as discussed in relation to FIGS. 7A-7C).

Figure 18:
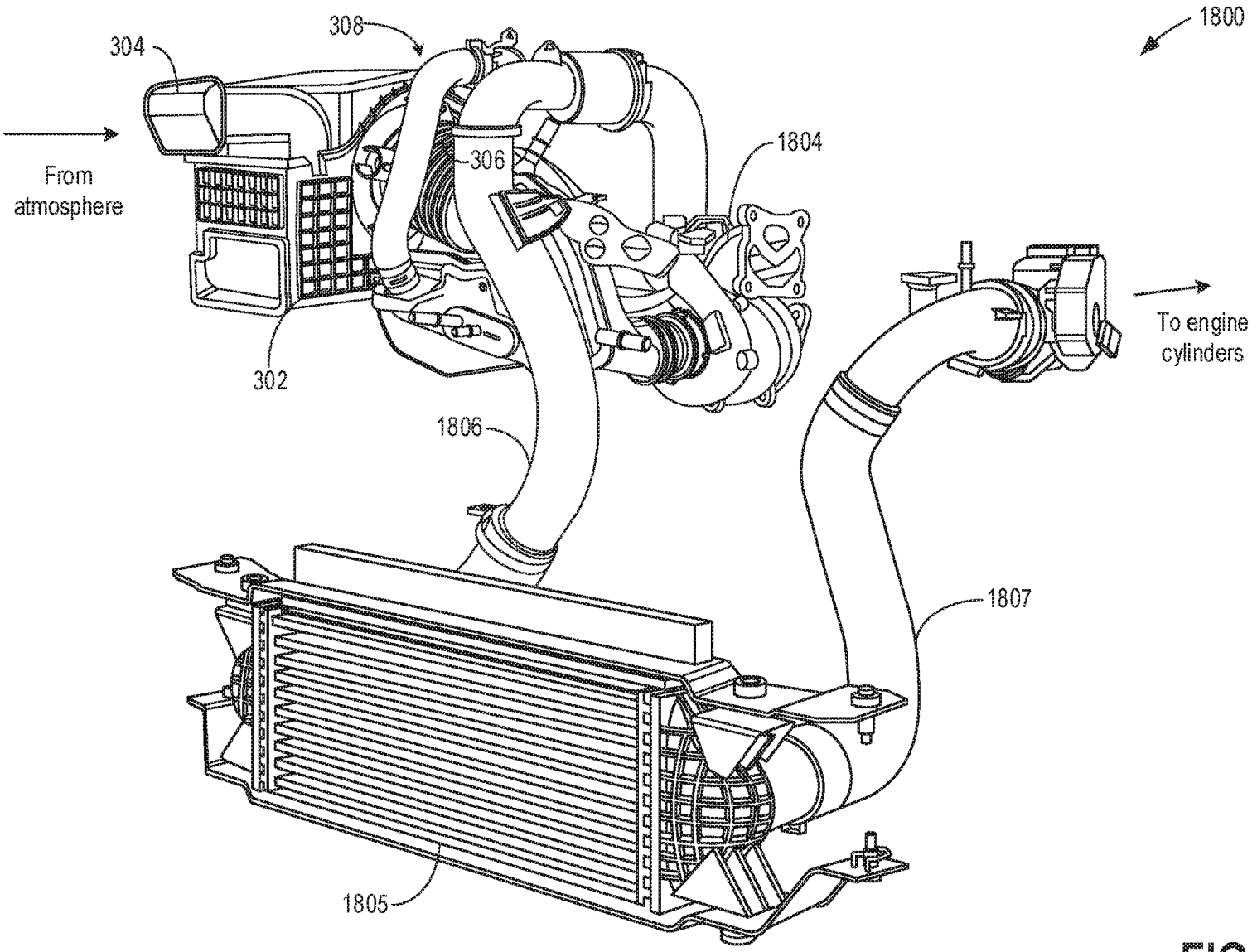
FIG. 18 shows the air induction system of FIG. 3 coupled within the engine system of FIG. 1.

FIG. 18 shows an example embodiment 1800 of the air induction system of FIG. 3 coupled within the engine system of FIG. 1. The air induction system may include an air cleaner box 302 for purifying air entering the engine system. Ambient air may enter the air cleaner box 302 via an intake passage 304 fluidically coupling the engine system to the atmosphere. The outlet of the air cleaner box 302 may include an air conduit 306 housing a hydrocarbon (HC) trap assembly 308. In one example, the HC trap assembly 308 may be coupled to a duct of the air induction system, the duct being one of a fresh air inlet tube, filter enclosure, clean air duct etc.

The HC trap may be configured to optimize evaporative emissions, air flow, and reduce noise and vibration in the engine air induction system. The HC trap may be pillow case type (with one or more lobed on a flat or curved breathable surface), or sheet media type (flat or curved sheet media with or without frame), or other HC Trap media/styles or combination of types/styles.

The air conduit 306 may lead to a turbocharger 1804 including a turbine coupled to an engine exhaust and a compressor coupled to a first engine intake air passage 1806. A charge air cooler 1805 may be coupled downstream of the turbocharger compressor. An intake duct 1806 may couple the turbocharger compressor to the charge air cooler 1805. An outlet duct 1807 originating from the charge air cooler 1805 may lead to the throttle body, the engine intake manifold, and the cylinders. Ambient air flowing through the air induction system may be compressed at the turbocharger compressor and then cooled at the charge air cooler 1805 before being delivered to the cylinders for combustion.

In this way, a HC trap may be coupled to the inner wall or the outer wall of an air induction system duct via a poke-yoke arrangement to simplify the assembly process (less number of parts) and reduce errors. By inserting the HC trap within a slot formed in a frame supported on the wall of the duct, retention of the HC trap may be simplified. The technical effect of coupling HC traps to windows integrally formed in the wall of the clean air duct is that multiple HC traps may be coupled in a plurality of orientations without adversely affecting airflow through the duct.

FIGS. 3-18 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

An example system comprises: a hydrocarbon (HC) trap housed within a cavity formed in a wall of an air conduit of an engine air induction system. In any preceding example, additionally or optionally, the air conduit is an outlet of an air cleaner box in the engine air induction system. In any or all of the preceding examples, additionally or optionally, the HC trap protrudes outward from an outer surface of the wall of the air conduit, the HC trap being one of a pillow-case type or a flat sheet media type. In any or all of the preceding examples, additionally or optionally, the system further comprising, an enclosure integrally formed around the cavity, the enclosure including a plurality of finger ribs and lands to support the HC trap in a symmetrical or poke-yoke assembly. In any or all of the preceding examples, additionally or optionally, the plurality of ribs and lands are formed on an inner wall of the enclosure, the plurality of retention ribs and lands having a distribution of length and thickness. In any or all of the preceding examples, additionally or optionally, the HC trap is covered by a retention cap including one or more rims, depressions, and corners, the HC trap parallel or perpendicular to a central axis of the air conduit. In any or all of the preceding examples, additionally or optionally, the HC trap includes a flat or curved base and one or more lobes positioned on the flat or curved base, the lobes containing a hydrocarbon adsorbent material. In any or all of the preceding examples, additionally or optionally, the system further comprising, one or more of pins located on the cavity or the retention cap. In any or all of the preceding examples, additionally or optionally, the HC trap includes one or more holes on a perimeter of the base to engage with one or more pins during assembly. In any or all of the preceding examples, additionally or optionally, the HC trap is inclined at an angle relative to a vertical or a horizontal axis of the air conduit. In any or all of the preceding examples, additionally or optionally, the system further comprising, two or more HC traps coupled to separate cavities integrally formed on the wall of the air conduit.

Another example engine system, comprises: a hydrocarbon (HC) trap inserted in a slot formed in a frame positioned within a bore of an air conduit of an engine air induction system. In any preceding example, additionally or optionally, the frame is a multiple piece structure including an upper part coupled to an inner surface of a wall of the air conduit and a lower part coupled to an inner surface of a wall of the air conduit, the slot formed within each of the upper part and the lower part. In any or all of the preceding examples, additionally or optionally, the frame is a one piece structure including the upper part coupled to the inner surface of the wall, the lower part coupled to the inner surface of the wall with or without a connecting arm joining the upper part and the lower part, the slot formed within each of the upper part, the lower part, and the connecting arm. In any or all of the preceding examples, additionally or optionally, the frame and the air conduit are injection molded as a single structure. In any or all of the preceding examples, additionally or optionally, the HC trap is a pillow-case type trap including a flat or curved surface with one or more lobes protruding outward or inward, the lobes enclosing a hydrocarbon adsorbent material, wherein the flat or curved surface is made of a breathable material allowing fluidic communication between the hydrocarbon adsorbent material and fluid passing through the air conduit.

Yet another example engine system, comprises: an air conduit coupled within an engine air induction system, an opening integrally formed in a wall of the air conduit, a frame injection molded around the opening, and a hydrocarbon (HC) trap inserted into a groove formed within the frame. In any preceding example, additionally or optionally, the frame is protruding outward or inward from an outer or inner surface of the wall, the frame including a first side, a second side, and a third side, the first side parallel to the second side and the third side parallel to a vertical or a horizontal axis of the air conduit, and each of the first side and the second side coupling the third side to the wall of the air conduit. In any or all of the preceding examples, additionally or optionally, the groove is formed between a pair of tabs and the third side of the frame, and wherein the HC trap is parallel to the vertical or the horizontal axis of the air conduit with a breathable surface of the HC trap facing the opening, the HC trap covered by a retention cap. In any or all of the preceding examples, additionally or optionally, the system further comprising: a first area between the third side and the wall of the air conduit being covered by a shield on one side of the frame, and a second area between the third side and the wall of the air conduit being open or being covered by a protective cap on an opposite side of the frame.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a hydrocarbon (HC) trap housed within a cavity formed in a wall of an air conduit of an engine air induction system, and a rectangular enclosure with a rim integrally formed around the cavity, wherein two opposite long side walls of the enclosure include a plurality of finger ribs on an inner side of a respective long side wall, the two opposite long side walls not contacting each other, and wherein two opposite short side walls of the enclosure each include one land, the two opposite short side walls not contacting each other;

wherein one end of each finger rib of the plurality of finger ribs is in face sharing contact with an arcuate surface of the cavity, the plurality finger ribs being of unequal height with a height of finger ribs progressively decreasing from an edge of the cavity to a center of the cavity, and wherein a top landing surface of each land is lower than a surface of the rim.

2. The system of claim 1, wherein the air conduit is an outlet of an air cleaner box in the engine air induction system.

3. The system of claim 1, wherein the HC trap protrudes outward from an outer surface of the wall of the air conduit, the HC trap being one of a pillow-case type or a flat sheet media type.

4. The system of claim 1, wherein the plurality of finger ribs and each land support or retain the HC trap in a symmetrical or poke-yoke assembly.

5. The system of claim 4, wherein the plurality of finger ribs and each land are formed on an inner wall of the enclosure, the plurality of finger ribs and each land having a distribution of length and thickness.

6. The system of claim 1, wherein the HC trap is covered by a retention cap including one or more rims, depressions, and corners, the HC trap parallel or perpendicular to a central axis of the air conduit.

7. The system of claim 1, wherein the HC trap includes a flat or curved base, and one or more lobes positioned on the base, the lobes containing a hydrocarbon adsorbent material.

8. The system of claim 6, further comprising, one or more pins located on the cavity or the retention cap.

9. The system of claim 8, wherein the HC trap includes one or more holes on a perimeter to engage with the one or more pins during assembly.

10. The method of claim 1, wherein the HC trap is inclined at an angle relative to a vertical or a horizontal axis of the air conduit.

11. The system of claim 1, further comprising, two or more HC traps coupled to separate cavities integrally formed on the wall of the air conduit.

12. The method of claim 1, wherein each land includes a rectangular wall facing the finger ribs and an arcuate wall adjacent to a wall of the two opposite short side walls, each land not contacting another land.

* * * * *